US011535480B2

(12) United States Patent
Shimizu et al.

(10) Patent No.: US 11,535,480 B2
(45) Date of Patent: Dec. 27, 2022

(54) SHEET PROCESSING APPARATUS AND IMAGE FORMING SYSTEM

(71) Applicants: Natsuki Shimizu, Yamanashi (JP); Takuya Katayama, Yamanashi (JP)

(72) Inventors: Natsuki Shimizu, Yamanashi (JP); Takuya Katayama, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/548,817

(22) Filed: Dec. 13, 2021

(65) Prior Publication Data

US 2022/0185617 A1 Jun. 16, 2022

(30) Foreign Application Priority Data

Dec. 15, 2020 (JP) ..... JP2020-207248

(51) Int. Cl.
*B65H 45/20* (2006.01)
*B65H 45/18* (2006.01)
*B65H 9/10* (2006.01)

(52) U.S. Cl.
CPC ..... *B65H 45/18* (2013.01); *B65H 9/101* (2013.01); *B65H 2301/17* (2013.01); *B65H 2301/3611* (2013.01); *B65H 2301/452* (2013.01)

(58) Field of Classification Search
CPC ..... B65H 45/20
See application file for complete search history.

(56) References Cited

U.S. PATENT DOCUMENTS 4,717,134 A * 1/1988 Iida ..... B65H 45/144 270/45
5,382,011 A * 1/1995 Tani ..... G03G 15/6582 270/37
7,871,065 B2 * 1/2011 Fukasawa ..... G03G 15/6582 270/32
7,883,086 B2 * 2/2011 Kamiya ..... B65H 31/26 271/223
7,896,338 B2 * 3/2011 Kamiya ..... B65H 39/10 271/220
7,975,999 B2 * 7/2011 Fukasawa ..... B65H 45/18 270/32
8,240,664 B2 * 8/2012 Sekigawa ..... G03G 15/6529 271/223

(Continued)

FOREIGN PATENT DOCUMENTS

JP 2012-056674 A 3/2012

*Primary Examiner* — Leslie A Nicholson, III
(74) *Attorney, Agent, or Firm* — Manabu Kanesaka

(57) ABSTRACT

To enable highly accurate fold processing by properly moving a sheet that has been subjected to fold processing. In a sheet processing apparatus that that performs fold processing in such a manner as to apply first fold processing to a sheet and then apply second fold processing at a position different from a fold line formed in the first fold processing so as to make one end of the sheet folded in the first fold processing lie inside the folded sheet, the first fold processing is applied to a sheet conveyed to an intermediate tray by a fold roller pair and, when a regulating stopper is moved to move the folded sheet that has been subjected to the first fold processing to a predetermined position of the intermediate tray, the folded sheet is gripped by a grip unit.

9 Claims, 16 Drawing Sheets

(56) References Cited

U.S. PATENT DOCUMENTS

| | | | | |
|---|---|---|---|---|
| 8,480,078 | B2 * | 7/2013 | Kubota | G03G 15/6552 271/220 |
| 9,102,117 | B2 * | 8/2015 | Suzuki | B65H 45/20 |
| 9,108,821 | B2 * | 8/2015 | Nakada | B65H 45/12 |
| 9,388,015 | B2 * | 7/2016 | Suzuki | B65H 45/147 |
| 10,196,228 | B2 * | 2/2019 | Allen | B65H 45/147 |

* cited by examiner

SHEET PROCESSING APPARATUS AND IMAGE FORMING SYSTEM

TECHNICAL FIELD

The present invention relates to a sheet processing apparatus for folding sheets fed from, for example, an image forming apparatus and an image forming system having the same.

BACKGROUND ART

There is conventionally known a sheet processing apparatus having a function of folding a sheet bundle into a booklet form as post-processing for sheets discharged from an image forming apparatus, such as a copier, a printer, a facsimile device, or a compound machine thereof. An example of this includes a sheet processing apparatus having a mechanism wherein sheets, which are fed from an image forming apparatus to be carried out to a sheet stacker, are thrust at its predetermined position toward the nip portion of a fold roller pair with a thrust plate while being folded and made to pass through the fold roller pair to be folded in two.

Some of the sheet processing apparatuses that perform sheet fold processing are configured to perform not only twofold processing but inward threefold processing in which a sheet is subjected to fold processing at two different positions such that one end of the sheet is inside the folded part. Such an apparatus is configured to convey in a switchback manner a sheet that has been subjected to first fold processing back to a stacker and then to perform second fold processing at a position different from that in the first fold processing to thereby fold the sheet inward in three (see JP2012-056674A).

DISCLOSURE OF INVENTION

Problems to be Solved by the Invention

In the sheet folding apparatus described in JP2012-056674A, fold processing is applied to the sheet at a first fold position, and the resultant sheet folded in two is conveyed in a switchback manner back to a conveying path formed by guide members disposed at a predetermined interval from each other. At this time, the fold line of the sheet folded in two tends to return to its original form. That is, force is generated in a direction in which the end portions of the sheet go outward. Thus, the sheet falls with the end portions thereof rubbed against the guide member, which may prevent the sheet from falling smoothly due to friction force generated at this time.

The present invention has been made in view of the above situation, and an object thereof is to provide a sheet processing apparatus capable of properly moving a folded sheet for highly accurate fold processing and an image forming system having such a sheet processing apparatus.

Means for Solving the Problem

To attain the above object, a sheet processing apparatus according to the present invention is a sheet processing apparatus that performs fold processing in such a manner as to apply first fold processing to a sheet and then apply second fold processing at a position different from a fold line formed in the first fold processing so as to make one end of the sheet folded in the first fold processing lie inside the other end of the sheet folded in the second fold processing.

The apparatus includes: a conveying path that guides a sheet conveyed in a predetermined conveying direction; a position adjusting unit that has a contacting part against which a downstream side end portion in the conveying direction contacts and that moves in the conveying direction and its opposite direction so as to adjust the position of the sheet; a grip unit configured to be movable integrally with the position adjusting unit and to grip the sheet adjusted in position by the position adjusting unit; a thrust member that thrusts the sheet adjusted in position by the position adjusting unit; a rotating body pair that rotates while pressing the sheet thrust by the thrust member at a nip part to apply fold processing to the sheet; and a control part that controls the driving of the position adjusting unit, the grip unit, the thrust member, and the rotating body pair, the control part using the rotating body pair to apply first fold processing to the sheet conveyed to the conveying path and causing the grip unit to grip the folded sheet, which has been subjected to the first fold processing, when the folded sheet is fed back to the conveying path by moving the position adjusting unit.

Advantageous Effect of the Invention

In the present invention, when a sheet that has been subjected to fold processing is fed back to a conveying path, the sheet is moved while being gripped, so that the sheet can be moved accurately to a predetermined position even when a force to open the fold position acts on the sheet folded in two. Further, since the sheet is gripped while being moved, highly accurate fold processing can be carried out.

MODE FOR CARRYING OUT THE INVENTION

First Embodiment

Figure 1:
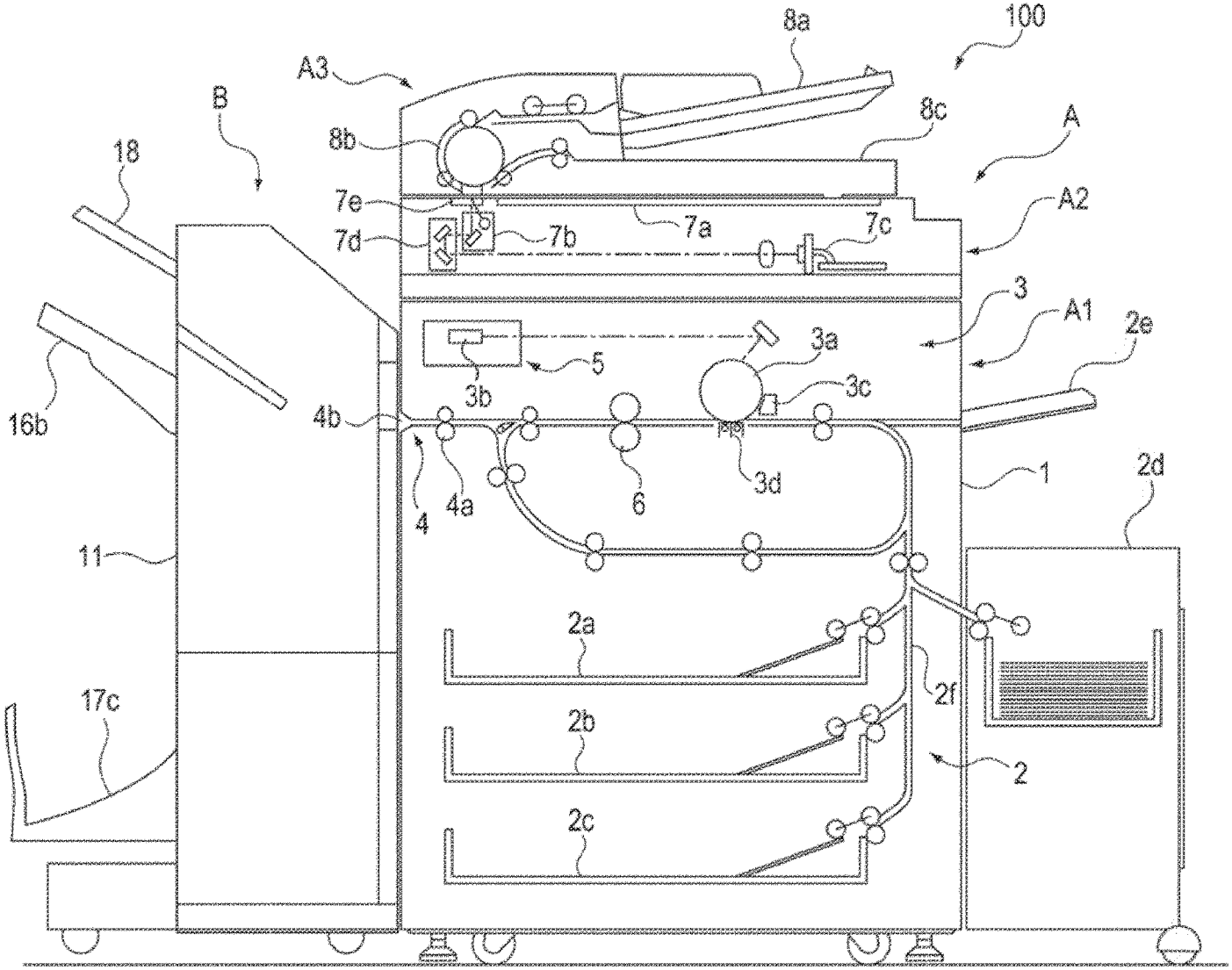
FIG. 1 is an explanatory view illustrating the entire configuration of an image forming system according to the present embodiment.

Hereinafter, a sheet processing apparatus according to preferred embodiments of the present invention and an image forming system having the same will be described with reference to the drawings. FIG. 1 schematically illustrates the entire configuration of an image forming system having a sheet processing apparatus according to the embodiments of the present invention. As illustrated in FIG. 1, an image forming system 100 includes an image forming apparatus A and a sheet processing apparatus B installed together therewith.

<Image Forming Apparatus>

The image forming apparatus A includes an image forming unit A1, a scanner unit A2, and a feeder unit A3. The image forming unit A1 includes, inside a housing 1, a feed part, an image forming part 3, a discharge part 4, and a data processing part 5.

The feed part 2 has a plurality of cassette mechanisms 2*a*, 2*b*, and 2*c* for storing image formation sheets of different sizes and delivers sheets of a size designated from a not-shown main body control part to a feed path 2*f*. The cassette mechanisms 2*a*, 2*b*, and 2*c* are each configured to be detachable from the feed part 2*e* and each incorporate a separating mechanism for separating sheets therein one by one and a feed mechanism for delivering sheets. The feed path 2*f* has a conveying roller for conveying the sheets fed from the cassette mechanisms 2*a*, 2*b*, and 2*c* to the downstream side and has, at its end, a registration roller pair for aligning sheet front ends.

The feed path 2*f* is connected with a large capacity cassette 2*d* and a manual feed tray 2*e*. The large capacity cassette 2*d* is constituted by an option unit for storing sheets of a size to be consumed in a large amount. The manual feed tray 2*e* is configured to feed thick sheets which are difficult to separate upon feeding and special sheets such as coated sheets and film sheets.

The image forming part 3 uses an electrophotographic system and has a rotating photosensitive drum 3*a* and an emitter 3*b* for emitting optical beam, a developing unit 3*c*, and a cleaner (not illustrated) which are disposed around the photosensitive drum 3*a*. The illustrated image forming part 3 is a monochrome printing mechanism and configured to irradiate the photosensitive drum 3*a* whose circumferential surface is uniformly electrically charged with light corresponding to an image signal using the emitter 3*b* to optically form a latent image and to attach toner ink to the latent image using the developing unit 3*c* to form a toner image.

A sheet is fed along the feed path 2*f* to the image forming part 3 at the timing of image formation on the photosensitive drum 3*a*, and a transfer bias is applied from a transfer charger 3*d* to the sheet to transfer the toner image formed on the photosensitive drum 3*a* onto the sheet. The sheet onto which the toner image has been transferred passes through a fixing unit 6 while being heated and pressurized, with the result that the toner image is fixed onto the sheet. The resultant sheet is then discharged from a discharge port 4*b* by a discharge roller 4*a* and conveyed to the sheet processing apparatus B to be described later.

The scanner unit A2 includes a platen 7*a* on which an image document is placed, a carriage 7*b* configured to reciprocate along the platen 7*a*, a photoelectric conversion unit 7*c*, and a reduction optical system 7*d* that guides reflecting light from the document on the platen 7*a* scanned by the carriage 7*b* to the photoelectric conversion unit 7*c*. The photoelectric conversion unit 7*c* photoelectric-converts an optical output from the reduction optical system 7*d* into image data and outputs the image data to the image forming part 3 as an electric signal.

The scanner unit A2 further includes a platen 7*e* so as to read the sheet fed from the feeder unit A3. The feeder unit A3 includes a feed tray 8*a* on which document sheets are loaded, a feed path 8*b* that guides the document sheet fed from the feed tray 8*a* to the platen 7*e*, and a discharge tray 8c that stores the document sheet that has passed the platen 7*e*. The document sheet from the feed tray 8*a* is read by the carriage 7*b* and reduction optical system 7*d* when passing through the platen 7*e*.

<Sheet Processing Apparatus>

The following describes the entire configuration of the sheet processing apparatus B that applies post-processing to the sheets fed from the image forming apparatus A.

Figure 2:
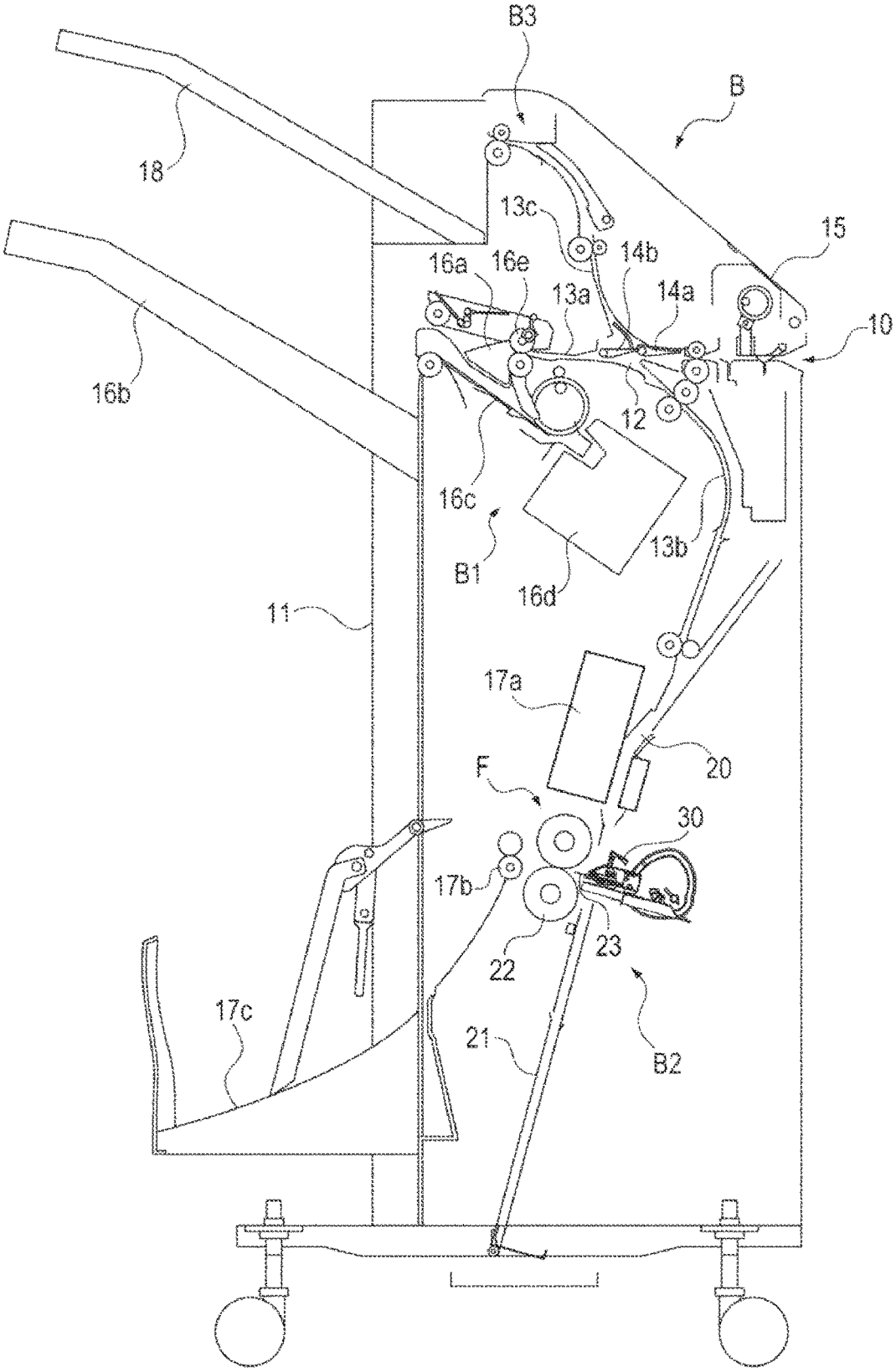
FIG. 2 is an explanatory view illustrating the entire configuration of a sheet processing apparatus in the image forming system.

FIG. 2 is an explanatory view illustrating the configuration of the sheet processing apparatus B according to the present embodiment. The sheet processing apparatus B has a housing 11 provided with a carry-in port 10 for introducing sheets from the image forming apparatus A. The housing 11 is positioned such that the carry-in port 10 communicates with the discharge port 4*b* provided in the housing 1 of the image forming apparatus A.

The sheet processing apparatus B has a sheet carry-in path 12*e* along which the sheet introduced from the carry-in port 10 is conveyed, first to third discharge paths 13*a*, 13*b*, and 13*c* branching from the sheet carry-in path 12*e*, and first and second path switch units 14*a* and 14*b*. The first and second path switch units 14*a* and 14*b* are each constituted by a flapper guide that changes the conveying direction of the sheet conveyed along the sheet carry-in path 12*e*.

The first path switch unit 14*a* uses a not-shown drive unit to switch between a mode that guides the sheet from the carry-in port 10 toward the first discharge path 13*a* for conveying the sheet in the lateral direction without changing the direction, a mode that guides the sheet from the carry-in port 10 toward the second discharge path 13*b* for conveying the sheet downward, and a mode that guides the sheet from the carry-in port 10 toward the third discharge path 13*c* for conveying the sheet upward. The first and second discharge paths 13*a* and 13*b* communicate with each other so as to allow the sheet that has once been introduced to the first discharge path 13*a* to be switchback-conveyed to the second discharge path 13*b* with the sheet conveying direction reversed.

The second path switch unit 14*b* is disposed at a downstream location from the first path switch unit 14*a* in the conveying direction of the sheet conveyed along the sheet carry-in path 12. The second path switch unit 14*b* uses the not-shown drive unit to switch between a mode that introduces the sheet that has passed the first path switch unit 14*a* to the first discharge path 13*a* and a mode that switchback-conveys the sheet that has once been introduced to the first discharge path 13*a* to the second discharge path 13*b*.

The sheet processing apparatus B includes first to third processing parts B1, B2, and B3 which perform different types of post-processing. Further, the sheet carry-in path 12 is provided with a punch unit 15 that punches a hole in the sheet carried therein.

The first processing part B1 is a binding processing part. Specifically, the first processing part B1 accumulates, aligns, and binds a plurality of sheets that have been discharged from a discharge port 16*a* at the downstream end of the first discharge path 13*a* in the conveying direction of the sheet conveyed along the sheet carry-in path 12*e* and then discharges the bound sheet bundle to a stack tray 16*b* provided outside the housing 11. The first processing part B1 has a sheet conveying device 16*c* that conveys a sheet or a sheet bundle and a binding processing unit 16*d* that binds a sheet bundle. The first discharge path 13*a* has, at its downstream end, a discharge roller pair 16*e* for sheet discharge from the discharge port 16*a* and for switchback conveyance from the first discharge path 13*a* to the second discharge path 13*b*.

The second processing part B2 is a fold processing part. Specifically, the second processing part B2 forms a sheet bundle by stacking a plurality of sheets switchback-conveyed from the second discharge path 13*b*, binds the sheet bundle, followed by fold processing. As will be described later, the second processing part B2 has a fold processing device F that folds the sheet or sheet bundle carried therein and a binding processing unit 17*a* arranged at immediately upstream location relative to the fold processing device F in the conveying direction of the sheet conveyed toward the second discharge path 13*b* and binds a sheet bundle. The sheet bundle that has been subjected to fold processing is discharged onto a stack tray 17*c* provided outside the housing 11 by a discharge roller 17*b*.

The third processing part B3 performs jog sorting to sort the sheets fed from the third discharge path 13*c* into a group stacked so as to be offset by a predetermined amount in the sheet width direction perpendicular to the conveying direction and a group stacked without being offset. The jog-sorted sheets are discharged onto a stack tray 18 provided outside the housing 11, and the sheet bundle of the offset group and the sheet bundle of the non-offset group are stacked on the stack tray 18.

Figure 3:
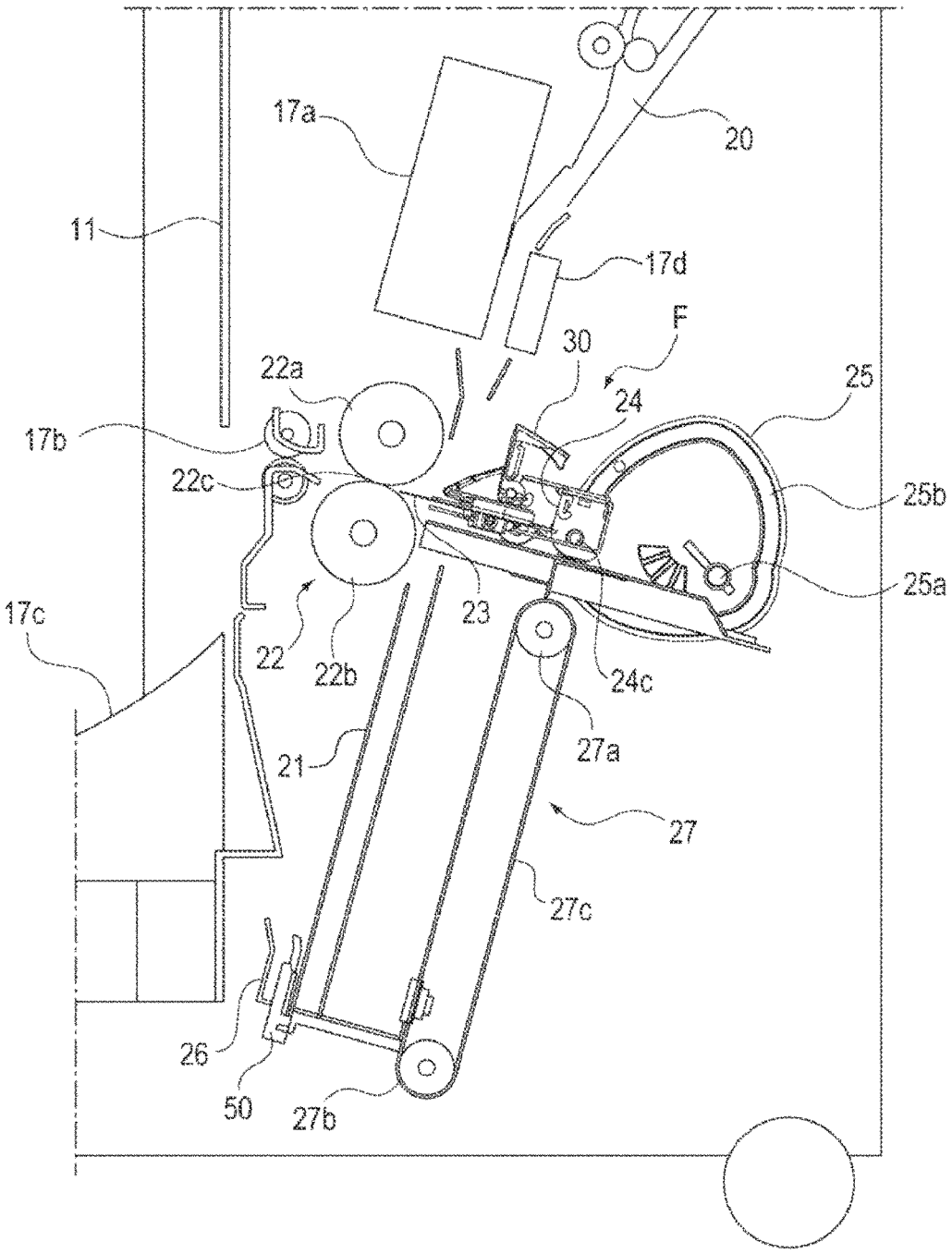
FIG. 3 is a cross-sectional view illustrating a fold processing device of the sheet processing apparatus.

FIG. 3 schematically illustrates the entire configuration of the second processing part B2. As described above, the second processing part B2 has the fold processing device F that folds in two the sheet bundle carried therein from the second discharge path 13*b* and stacked in a collated manner and the binding processing unit 17*a* that binds a sheet bundle before being folded. The illustrated binding processing unit 17*a* is a stapler device that drives a staple needle into a sheet bundle to binds it.

The second discharge path 13*b* is connected with a sheet conveying path 20 so as to carry sheets into the fold processing device F. An intermediate tray 21 constituting a part of the sheet conveying path 20 is provided downstream of the sheet conveying path 20 in the conveying direction of the sheet conveyed from the second discharge path 13*b* to the intermediate tray 21. On the intermediate tray 21, sheets to be folded are positioned and stacked. The binding processing unit 17*a* and a needle receiving part 17*d* are provided at immediately upstream locations relative to the intermediate tray 21 so as to face each other across the sheet conveying path 20.

<Fold Processing Device>

A fold roller pair 22 as a fold rotating body pair is provided on one side of the intermediate tray 21 so as to face one surface of the sheet or sheet bundle stacked in the intermediate tray 21. The fold roller pair 22 is composed of fold rollers 22*a* and 22*b* whose roller surfaces are brought into pressure contact with each other, and a nip part 22*c*, which is the pressure contact part therebetween, and disposed facing the intermediate tray 21. The fold rollers 22*a* and 22*b* are juxtaposed respectively on the upstream and downstream sides in the conveying direction of the sheet conveyed to the intermediate tray 21 from the upstream side above the intermediate tray 21 to the downstream side below the intermediate tray 21 in such a way as to be both equally distanced from the intermediate tray 21. In the present invention, the rotating part functioning as the fold rotating body is not limited to the fold rollers 22*a* and 22*b*, but may be, for example, a rotating belt. Further, the fold roller pair 22 may have a configuration in which a plurality of rollers (rotating bodies) are continuously disposed in series along the axial direction of each of the fold rollers 22*a* and 22*b*.

A fold blade 23 serving as a thrust member is disposed on the side opposite to the fold roller pair 22 with respect to the intermediate tray 21. The fold blade 23 is supported on a blade carrier 24 with its distal end facing the nip part 22*c* of the fold roller pair 22. The blade carrier 24 can be made to travel by a moving unit constituted by a cam member or the like to a direction traversing the intermediate tray 21 at substantially right angles, i.e., a direction intersecting the conveying direction of the sheet conveyed from the second discharge path 13*b* to the intermediate tray 21.

A cam member 25 composed of a pair of eccentric cams (only one eccentric cam is illustrated in FIG. 3), which are mirror-symmetric with each other, are provided so as to face each other across the blade carrier 24 in the front-rear direction (axial direction of the fold roller) in FIG. 3. The cam member 25 is rotated by a drive unit such as a drive motor about a rotary shaft 25*a* provided at the eccentric position. The cam member 25 has a cam groove 25*b* along the outer peripheral edge thereof.

The blade carrier 24 has, as a cam follower, a cam pin 24*c* freely slidably fitted in the cam groove 25*b*.

The blade carrier 24 can be caused to reciprocally travel by a drive motor rotating the cam member 25 in a direction approaching or separating from the intermediate tray 21. This allows, as illustrated in FIG. 3, the fold blade 23 to linearly freely move forward and backward between an initial position where the distal end of the fold blade 23 does not enter the sheet conveying path formed by the intermediate tray 21 and a maximum protruding position where the distal end of the fold blade 23 is nipped at the nip part 22*c* of the fold roller pair 22 along a protruding path connecting both the initial and maximum protruding positions.

A regulating stopper 26 is disposed at the lower end of the intermediate tray 21. The regulating stopper 26 serves as a position adjusting unit for adjusting sheet position in the conveying path. To this end, the regulating stopper 26 is configured to make the front end of the conveyed sheet in the conveying direction contact thereagainst for regulating. The regulating stopper 26 can be elevated and lowered along the intermediate tray 21 by a sheet elevating/lowering mechanism 27.

The sheet elevating/lowering mechanism 27 according to the present embodiment is a conveyer belt mechanism disposed on the side opposite to the fold roller pair 22 with respect to the intermediate tray 21 and below the blade carrier 24 when being located at the initial position where the distal end of the fold blade 23 does not enter the sheet conveying path formed by the intermediate tray 21. The sheet elevating/lowering mechanism 27 includes a pair of pulleys 27*a* and 27*b* disposed respectively near the upper and lower ends of the intermediate tray 21 along the intermediate tray 21 and a transmission belt 27*c* wound around the pulleys to constitute a conveyer belt mechanism. The regulating stopper 26 is fixed onto the transmission belt 27*c*. Rotating the drive side pulley 27*a* or 27*b* by a drive unit such as a drive motor allows the regulating stopper 26 to be elevated and lowered between the lower end position illustrated in FIG. 3 and a predetermined height position to thereby move a sheet or a sheet bundle along the intermediate tray 21 for positioning thereof at a predetermined height position.

The regulating stopper 26 thus configured to be vertically movable along the intermediate tray 21 is attached with a grip unit 50 which can be vertically moved together with the regulating stopper 26. The grip unit 50 grips the sheet conveyed to the intermediate tray 21 so as to allow reliable movement of the sheet in association with the movement of the regulating stopper 26.

Figure 4A:
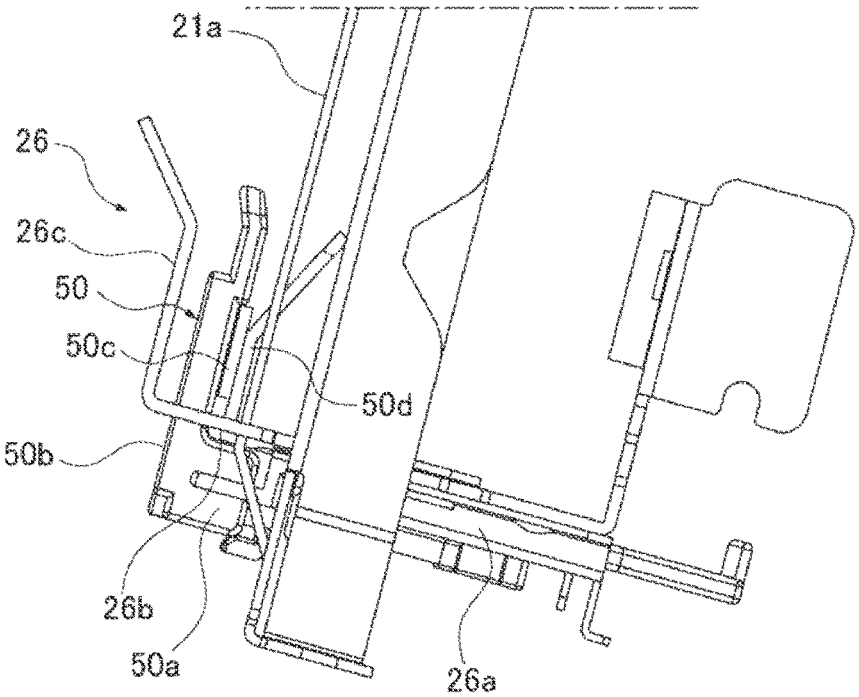
FIG. 4A is a cross-sectional view illustrating a grip state of a grip unit.
Figure 4B:
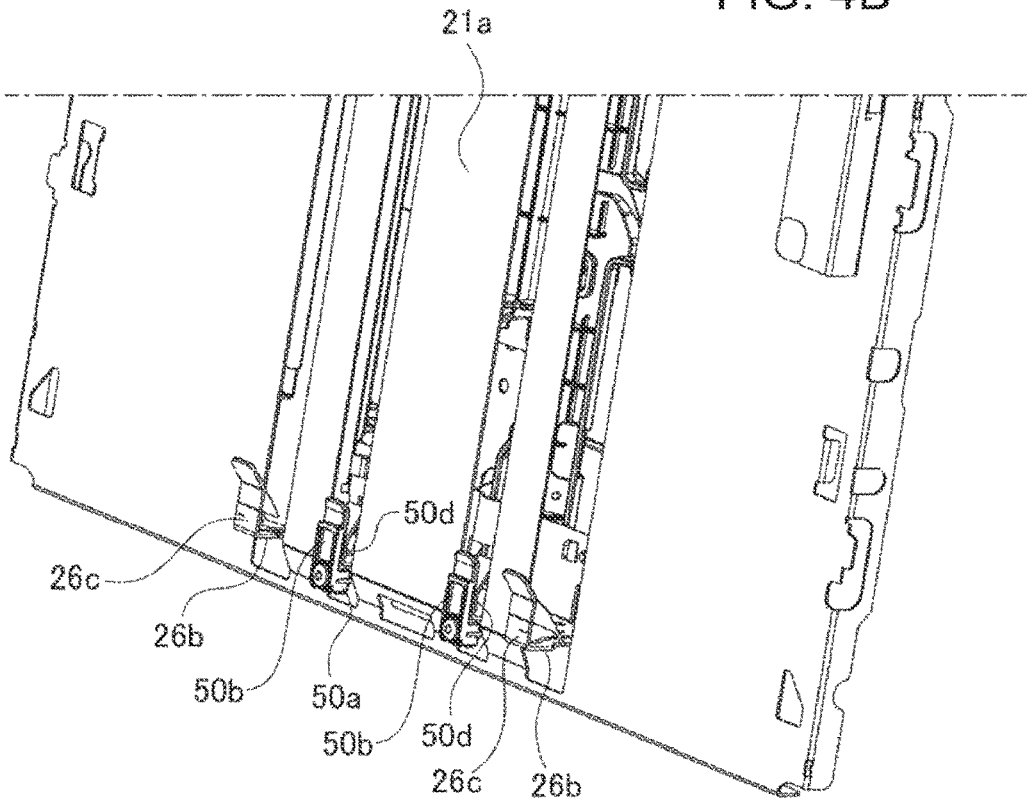
FIG. 4B is a perspective view of FIG. 4A.
Figure 5A:
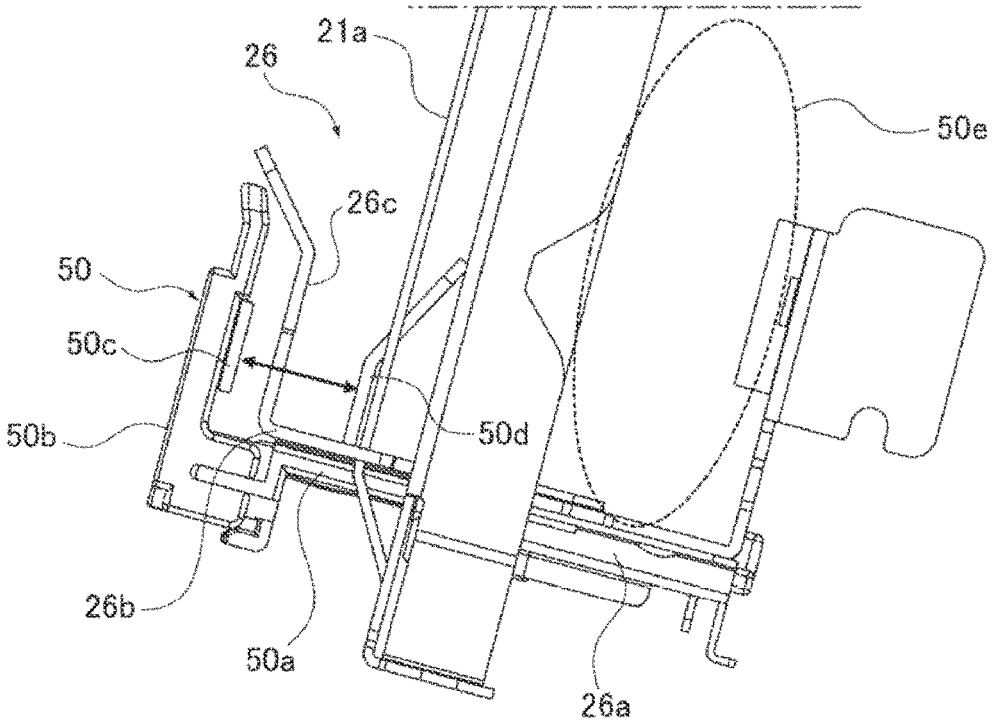
FIG. 5A is a cross-sectional view illustrating a grip release state of a grip unit.
Figure 5B:
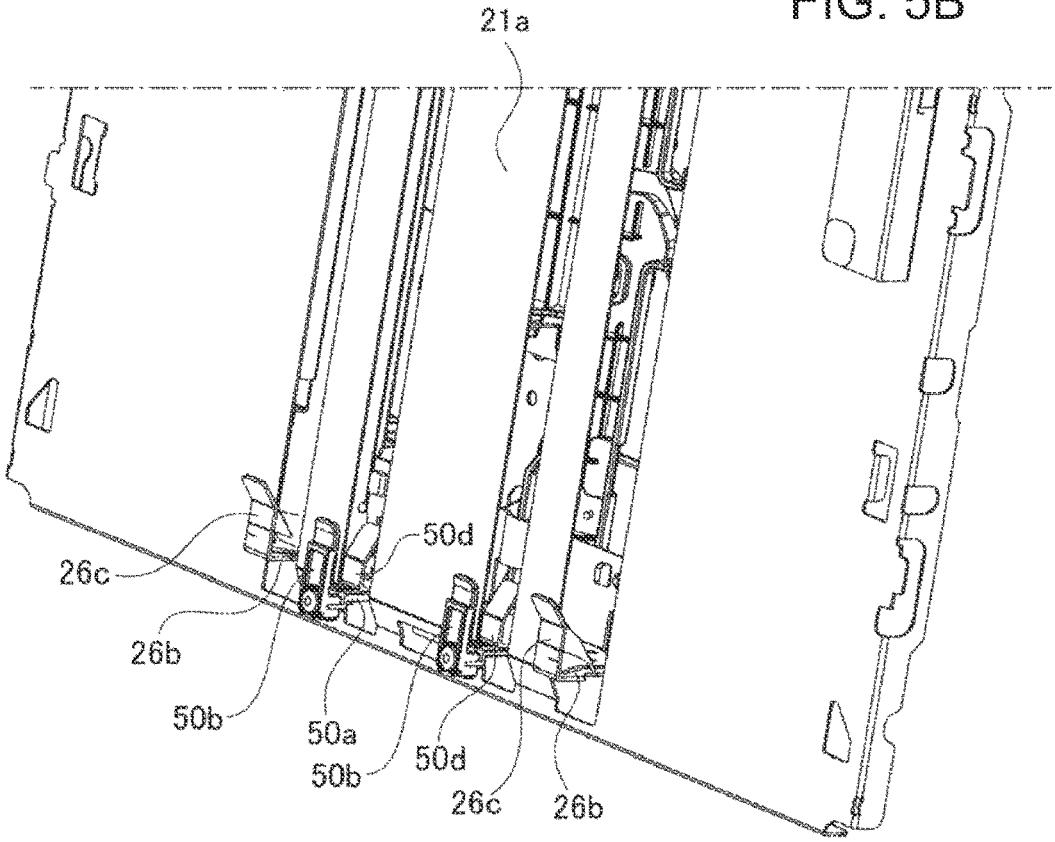
FIG. 5B is a perspective view of FIG. 5A.

The following describes the configuration of the grip unit 50 with reference to FIGS. 4 and 5. FIG. 4A is a cross-sectional view illustrating a state where the grip unit 50 can grip the sheet, and FIG. 4B is a perspective view illustrating the state of FIG. 4A. FIG. 5A is a cross-sectional view illustrating a state where the grip unit 50 releases its grip on the sheet, and FIG. 5B is a perspective view illustrating the state of FIG. 5A.

As illustrated in FIGS. 4A and 4B, the grip unit 50 is attached to the regulating stopper 26. The regulating stopper 26 is provided with a contacting part 26*b* at a base part 26*a* configured to be movable along a guide surface 21*a* of the intermediate tray 21 through drive transmission from the transmission belt 27*c*. When the lower end of the sheet conveyed to the intermediate tray 21 contacts against the contacting part 26*b*, the sheet is positioned. At the time of fold processing, the position of the contacting part 26*b* is adjusted so as to move the sheet to a fold processing position properly. The contacting part 26*b* has an erected part 26*c* which is successively bent at right angles, preventing the sheet contacting against the contacting part 26*b* from falling off.

The grip unit 50 is attached to the base part 26*a* and moves together therewith when the base part 26*a* moves along the guide surface 21*a*. In the grip unit 50, the erected part 50*b* is formed integrally with a support part 50*a* which is attached to the base part 26*a* so as to be slidable in the thickness direction of the sheet perpendicular to the conveying direction of the sheet conveyed to the intermediate tray 21, and the grip part 50*c* is formed on the inner surface side of the erected part 50*b*. The grip unit further has a facing part 50*d* which is formed integrally with the base part 26*a* so as to face the grip part 50*c* across the sheet conveying path of the intermediate tray 21.

An elastic member (not illustrated) such as a spring is attached between the base part 26*a* and the support part 50*a* so as to constantly bias the erected part 50*b* toward the facing part 50*d*. Thus, in the normal state, the grip part 50*c* is pressed against the facing part 50*d* to form a state where it can grip the sheet conveyed to the intermediate tray 21, so-called a grip state (see FIGS. 4A and 4B).

Further, as illustrated in FIG. 5A, the base part 26*a* is provided with a grip cam 50*e* engaged with the support part 50*a* and a cam motor (not illustrated) that rotates the grip cam 50*e*. The grip cam 50*e* has a large diameter portion and a small diameter portion. When the grip cam 50*e* is rotated, the support part 50*a* engaged therewith is slid in the direction of the arrow illustrated in FIG. 5A to cause the grip part 50*c* to contact against and separate from the facing part 50*d*. In this manner, the grip unit 50 can be switched between a grip state and a grip release state.

The support part 50*a* is provided below the contacting part 26*b* of the regulating stopper 26, that is, provided further away from the fold roller pair 22 than the contacting part 26*b*. This allows the sheet that has contacted against the contacting part 26*b* and is hence placed in position to be reliably gripped without interference with the positioning. Further, the grip part 50*c* configured to grip the sheet is provided above the contacting part 26*b*, that is, provided closer to the fold roller pair 22 than the contacting part 26*b*, allowing the sheet that has contacted at its end portion against the contacting part 26*b* to be reliably gripped.

Figure 6:
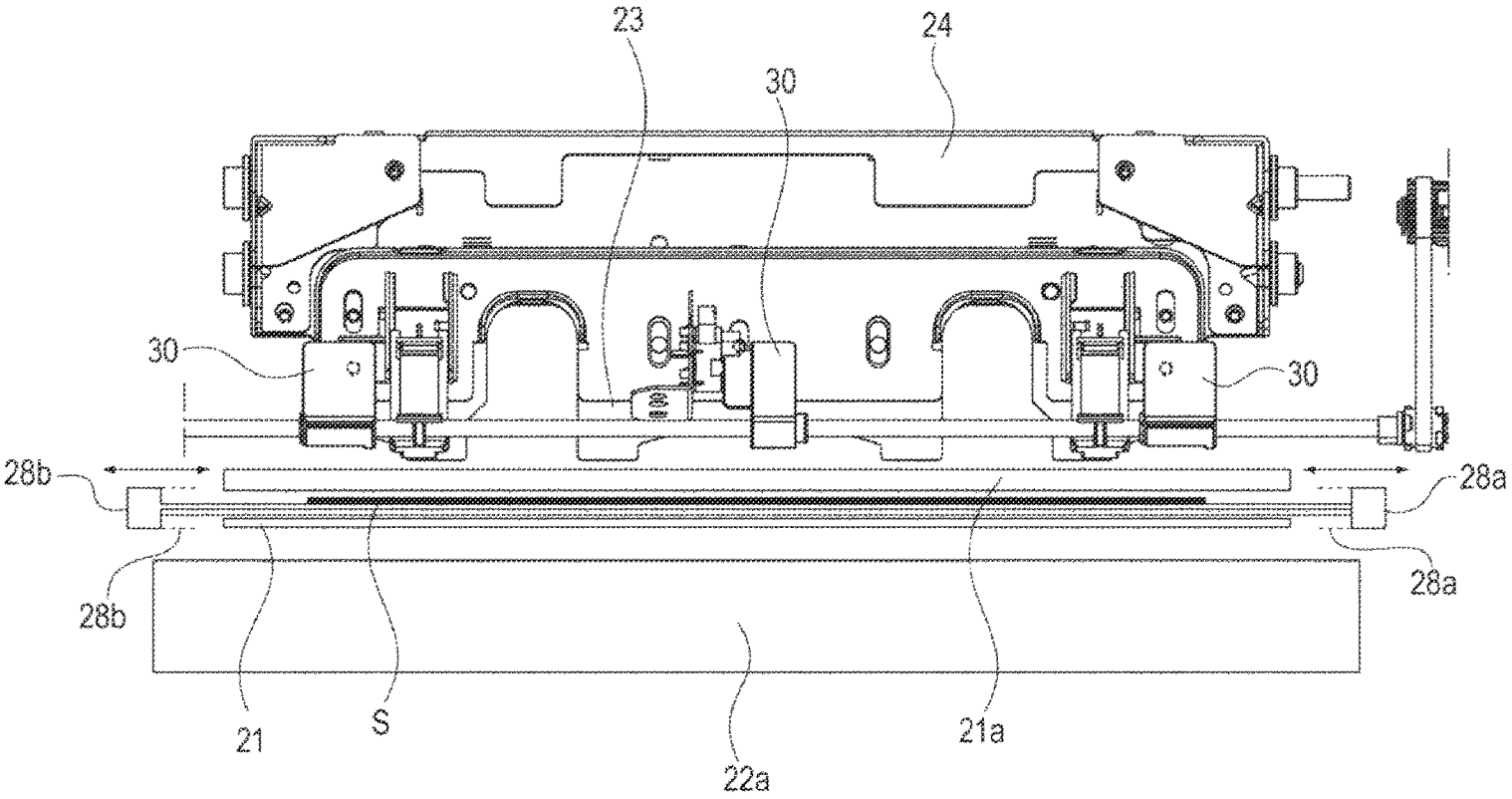
FIG. 6 is a plan view illustrating the fold processing device.

The fold processing device F according to the present embodiment further has a sheet side aligning mechanism for aligning the side of the sheet to be carried into the intermediate tray 21. As illustrated in FIG. 6, the sheet side aligning mechanism has a pair of sheet side aligning members 28*a* and 28*b* symmetrically disposed on both sides of the intermediate tray 21 in the sheet width direction (the direction perpendicular to the sheet conveying direction). FIG. 6 is a schematic plan view as viewed from above the fold processing device F. The sheet side aligning members 28*a* and 28*b* are movably supported so as to relatively approach and separate from each other in the sheet width direction. The sheet side aligning members 28*a* and 28*b* are moved with respect to the sheet that has contacted, at its front end, against the regulating stopper 26, whereby the position of the sheet in the sheet width direction is aligned.

<Control Part>

Figure 7:
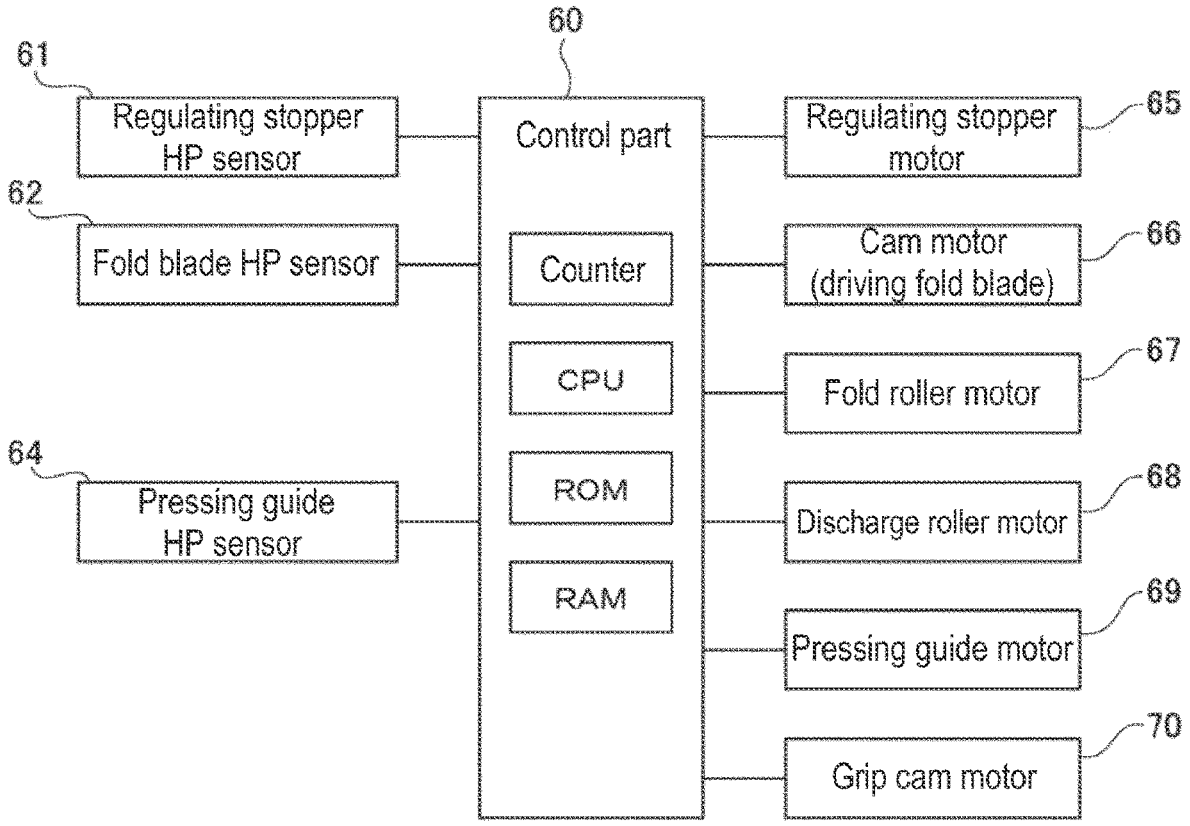
FIG. 7 is a block diagram of a fold processing control configuration.

The following describes the control configuration of the drive system in the sheet fold processing. As illustrated in the block diagram of FIG. 7, a control part 60 receives inputs of detection signals or various processing signals from various types of detection sensors and controls the driving of the various types of drive motors according to the input signals. For example, the various types of detection sensors include a regulating stopper HP sensor 61 for detecting whether the regulating stopper 26 is located at its home position, a fold blade HP sensor 62 for detecting whether the fold blade 23 is located at its home position, and a pressing guide HP sensor 64 for detecting whether a pressing guide member 30 (see FIGS. 10A and 10B) is located at its home position.

Figure 8:
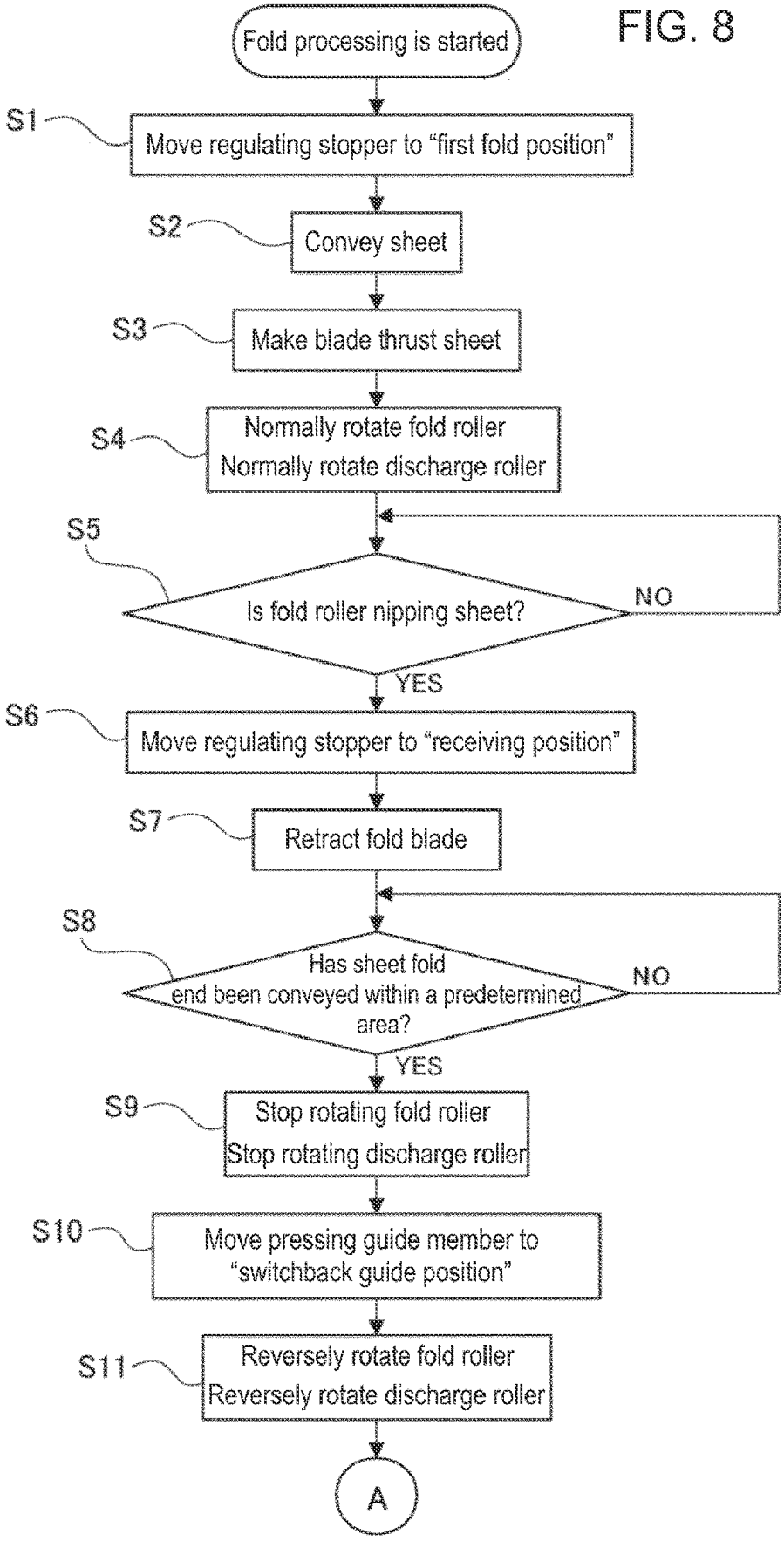
FIG. 8 is a flowchart illustrating an inward threefold processing sequence.
Figure 9:
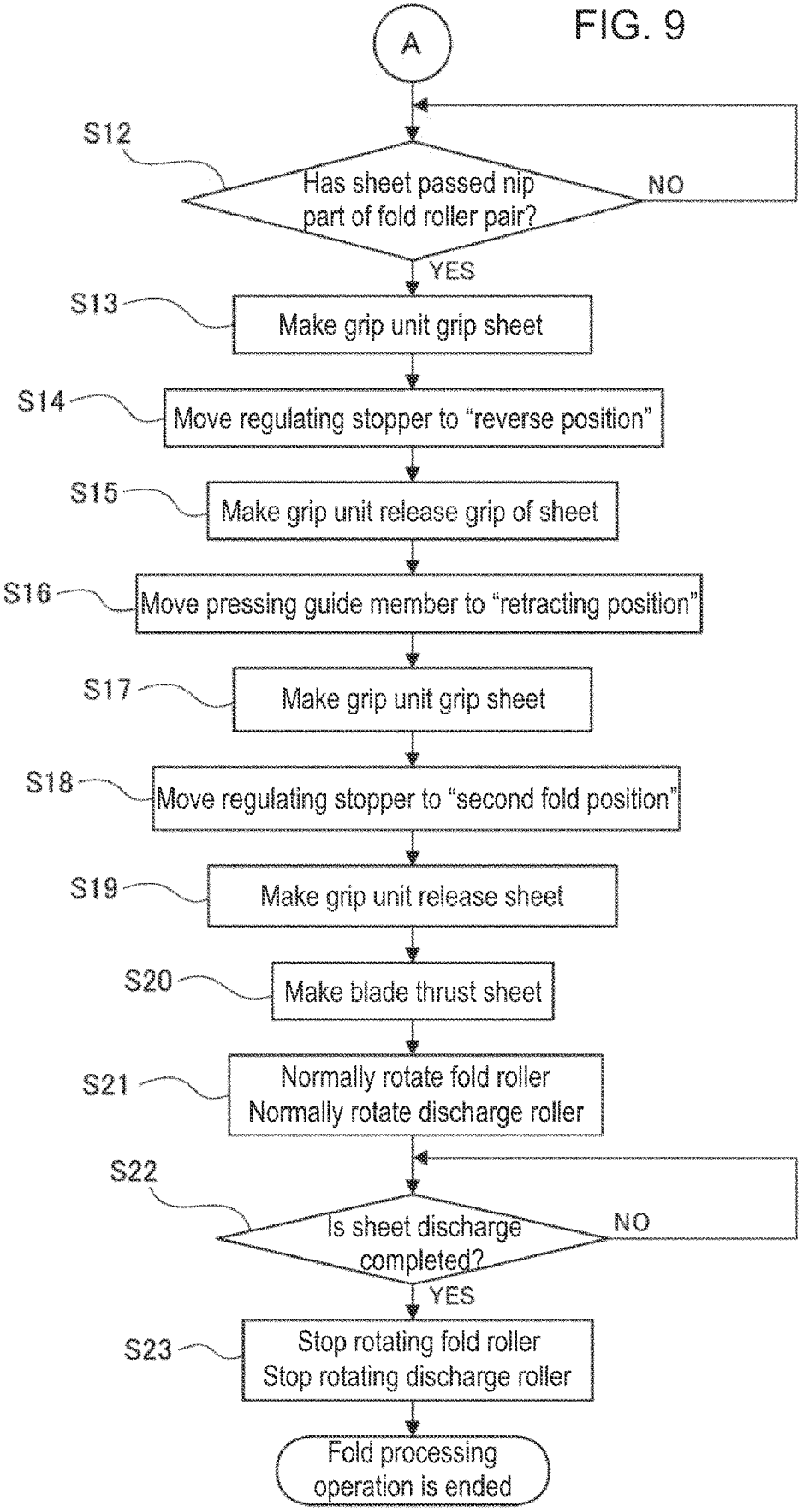
FIG. 9 is a flowchart illustrating the inward threefold processing sequence.

The control part 60 drive-controls various motors in response to the received input signals in the sequence of the flowcharts illustrated in FIGS. 8 and 9. The various motors include a regulating stopper motor 65 that drives the sheet elevating/lowering mechanism 27 for elevating and lowering the regulating stopper 26, a cam motor 66 that drives the cam member 25 for operating the blade carrier 24, a fold roller motor 67 that drives the fold roller pair 22 into rotation, a discharge roller motor 68 that drives the discharge roller 17*b* serving as a sheet conveying unit into rotation, a pressing guide motor 69 for operating the pressing guide member 30, and a grip cam motor 70 for driving the grip cam 50*e* of the grip unit 50 into rotation.

<Threefold Processing Operation>

FIGS. 8 and 9 are flowcharts illustrating the operation sequences of respective members when the sheet that has been conveyed to the intermediate tray 21 is folded inward in three by the fold processing device F. The inward threefold processing includes the first fold processing of folding the sheet in two and the second fold processing of folding the sheet at a position different from that in the first fold processing. Specifically, one end portion of the sheet folded in the first fold processing is folded inside the sheet folded in the second fold processing.

When performing the inward threefold processing, the fold processing device F according to the present invention uses the grip unit to grip the sheet that has been folded in two in the first fold processing when feeding back the sheet folded in two to the intermediate tray 21 and moves the regulating stopper 26 so as to reliably move the sheet to a predetermined position.

The following describes the operation of the fold processing device F according to the present embodiment when performing the inward threefold processing with reference to the flowcharts of FIGS. 8 and 9 and schematic cross-sectional views of FIGS. 10A to 16B illustrating the operations of respective components according to the flow of a sheet S in the inward threefold processing.

When fold processing is started, the regulating stopper 26 moves to a "first fold processing position" (S1). The first fold processing position is a position where the fold position of the sheet S to be subjected to the first fold processing is aligned with the fold blade 23 when a front end E1 of the conveyed sheet contacts against the contacting part 26*b*. At this time, the grip unit 50 is in a grip release state due to rotation of the grip cam 50*e*, that is, the grip part 50*c* is separated from the facing part 50*d* to allow the regulating stopper 26 to receive the sheet.

Figure 10B:
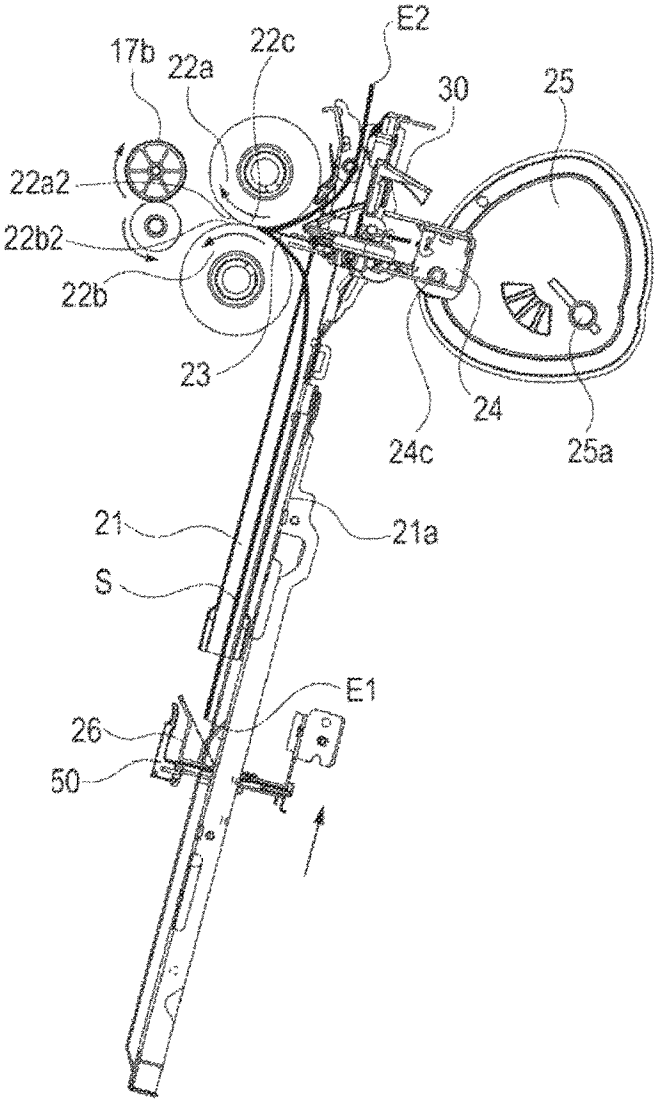
FIGS. 10A and 10B are cross-sectional views for explaining an inward threefold processing operation.
Figure 10A:
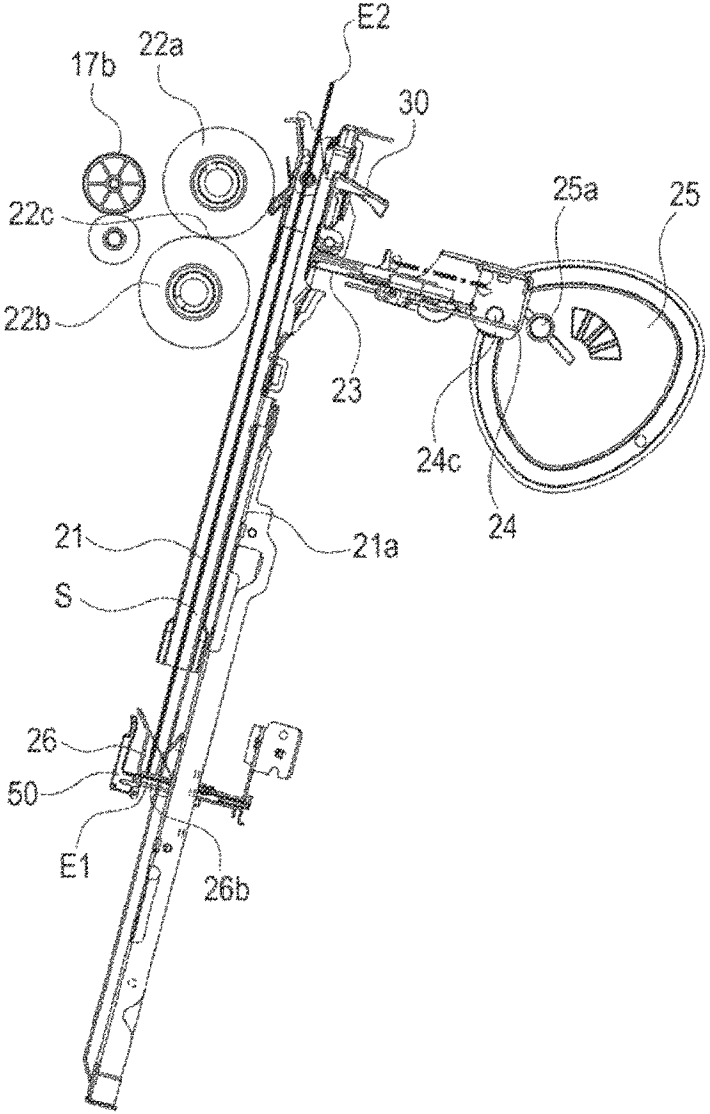

As illustrated in FIG. 10A, the intermediate tray 21 according to the present embodiment is inclined with respect to the vertical direction. When the sheet S is conveyed so as to fall, with the sheet front end E1 at the bottom and a sheet rear end E2 at the top, while the surface thereof on one side is guided by the guide surface 21*a* constituting the intermediate tray 21 and is stopped when the sheet front end E1 contacts against the contacting part 26*b* of the regulating stopper 26 (S2).

The fold blade 23 is disposed at a position where it thrusts the sheet S from the side of the guide surface 21*a* of the intermediate tray 21 toward the fold roller pair 22. In other words, the guide surface 21*a* of the intermediate tray 21 and the fold roller pair 22 are arranged so as to correspond in position to each other across the sheet S.

When fold processing is started, as illustrated in FIG. 10B, the cam motor 66 is driven to move the blade carrier 24 toward the fold roller pair 22, causing the fold blade 23 to contact against a first fold position F1 of the sheet S to thrust the fold position toward the nip part 22*c* (S3). Simultaneously, the fold roller motor 67 and discharge roller motor 68 are driven to rotate the fold roller pair 22 and discharge roller 17*b* in the normal rotation direction (S4). When pulse motors are used as the above-mentioned various motors, the number of drive pulses thereof is counted by a counter. When DC motors are used as the above-mentioned various motors, slits of a code wheel (slit plate) attached to the rotary shaft of the motor are read by a sensor, and the number of slits is counted by a counter. A sheet conveying amount, a sheet thrust amount, and the like can be detected by the obtained count values.

When the sheet S thrust by the fold blade 23 is made to reach the nip part 22*c* by the fold roller pair 22 to be nipped (S5), the regulating stopper 26 starts moving to a "receiving position" (S6). The receiving position is a position where, when the sheet that has been subjected to the first fold processing by the fold roller pair 22 is switched back to the intermediate tray 21 by reverse rotation of the fold roller pair 22, the sheet end E1 on the farther side from the fold position can contact against the contacting part 26*b* of the regulating stopper 26 immediately before the folded sheet passes through the nip part 22*c* of the fold roller pair 22.

When the regulating stopper 26 is thus moved toward the sheet during the fold processing, the regulating stopper 26 may contact against the end portion of the sheet thrust by the fold blade 23, which may displace the fold position of the sheet with respect to the fold blade 23. However, in the present embodiment, the regulating stopper 26 is moved to the receiving position after the sheet S is nipped at the nip part 22*c*, thus preventing displacement of the sheet fold position even when the regulating stopper 26 contacts against the sheet end portion.

The regulating stopper 26 may start moving before the sheet reaches the nip part 22*c* of the fold roller pair 22. In this case, it is necessary to move the regulating stopper 26 at a sheet conveying speed lower than a speed at which the sheet is thrust by the fold blade 23 so as not to allow the moving regulating stopper 26 to contact against the end portion of the sheet thrust toward the nip part 22*c*.

After the fold blade 23 thrusts the first sheet fold position of the sheet toward the nip part 22*c* of the fold roller pair 22 by a predetermined amount, it is reversely moved by the rotation of the cam member 25 to its home position (S7).

Figure 11B:
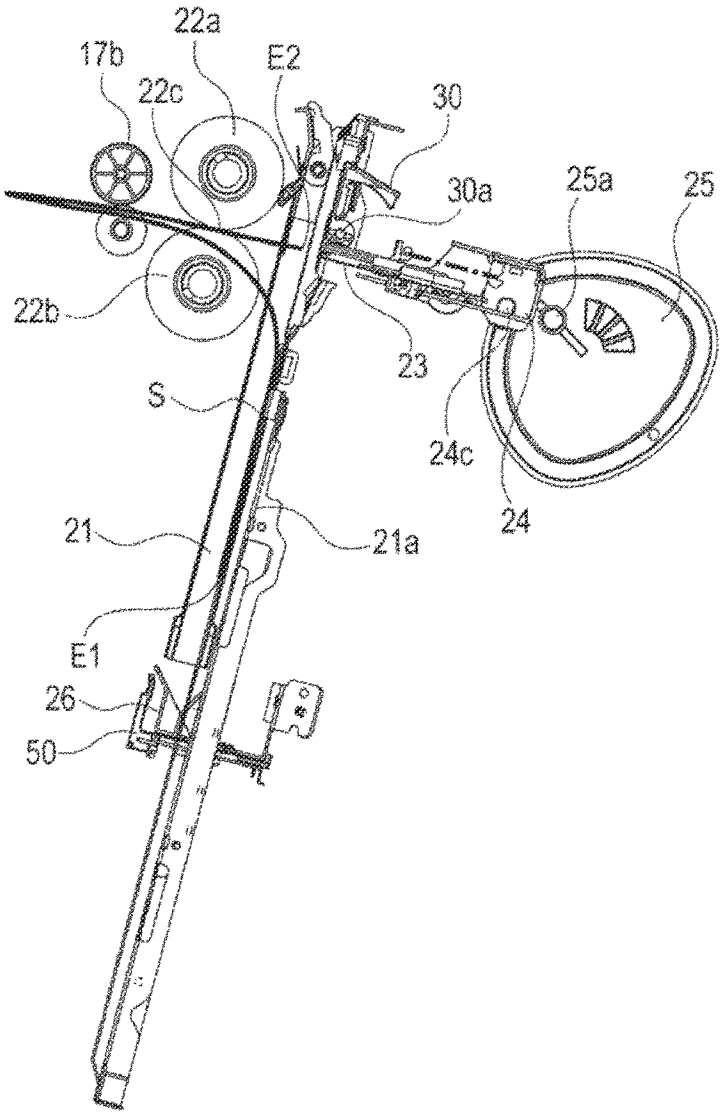
FIGS. 11A and 11B are cross-sectional views for explaining the inward threefold processing operation.
Figure 11A:
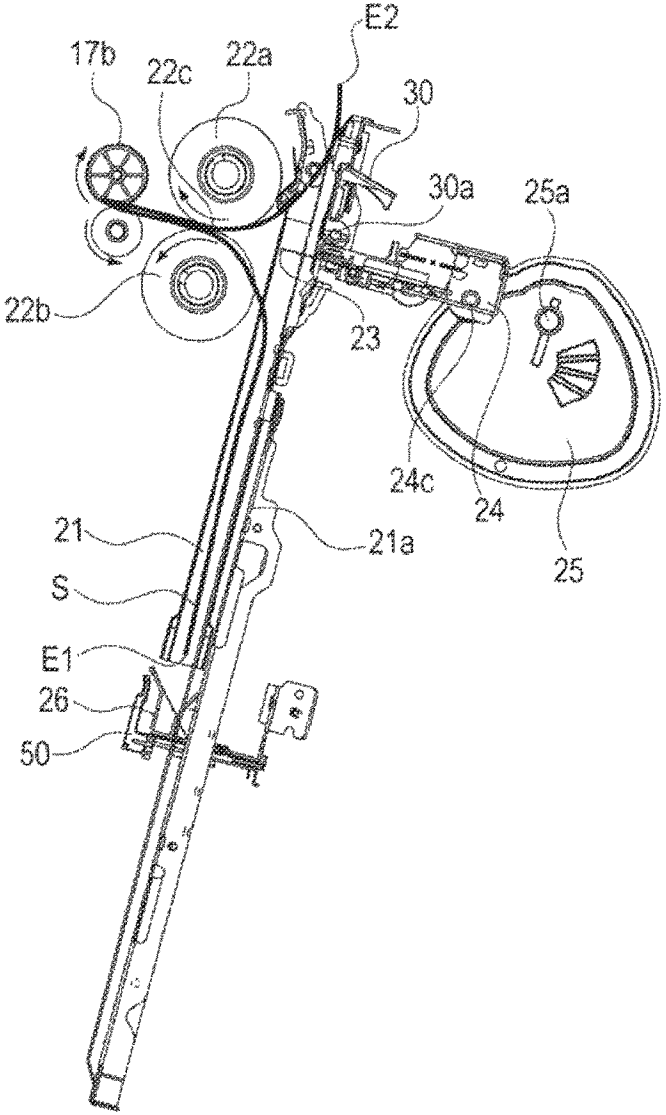

The thrust of the fold blade 23 causes the sheet S to be thrust into the nip part 22*c* at which first roller surfaces 222 and 222 of the fold roller pair 22 are brought into contact with each other to be pressed at a predetermined pressing force and folded while being nipped and conveyed by the fold roller pair 22 as illustrated in FIG. 11A and conveyed by the discharge roller 17*b* constituting the sheet conveying unit together with the fold roller pair 22. At this time, the movement of the regulating stopper 26 to the receiving position has been completed.

Then, for the second fold processing, as illustrated in FIG. 11B, sheet conveyance is stopped at the point of time when the rear end E2 of the sheet that has been subjected to the first fold processing reaches a predetermined position (S8, S9). The predetermined position is a position where the sheet rear end E2 on the side closer to the fold position is carried in the sheet conveying path formed by the intermediate tray 21. An L-shaped pressing guide member 30 is disposed above the fold blade 23 so as to be turnable about a turning shaft 30*a*. When the sheet conveyance is stopped at the point of time when the sheet rear end E2 reaches a predetermined position as described above, the sheet rear end E2 is preferably positioned below (extending direction of the intermediate tray 21 in which the sheet front end E1 is positioned) the turning shaft 30*a*. In this state, the fold roller pair 22 and discharge roller 17*b* are reversely driven to perform switchback conveyance. The sheet rear end E2 is the end portion (hereinafter, referred to as "fold end") folded inside the sheet folded by the second fold processing in the inward threefold processing.

Figure 12B:
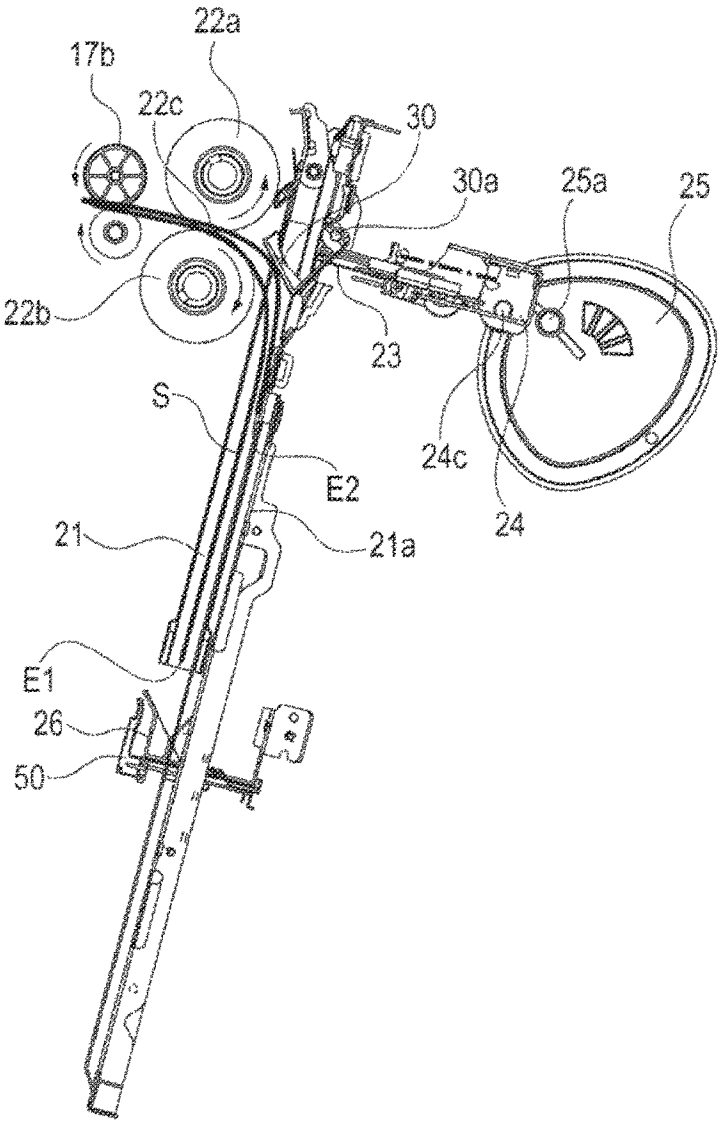
FIGS. 12A and 12B are cross-sectional views for explaining the inward threefold processing operation.
Figure 12A:
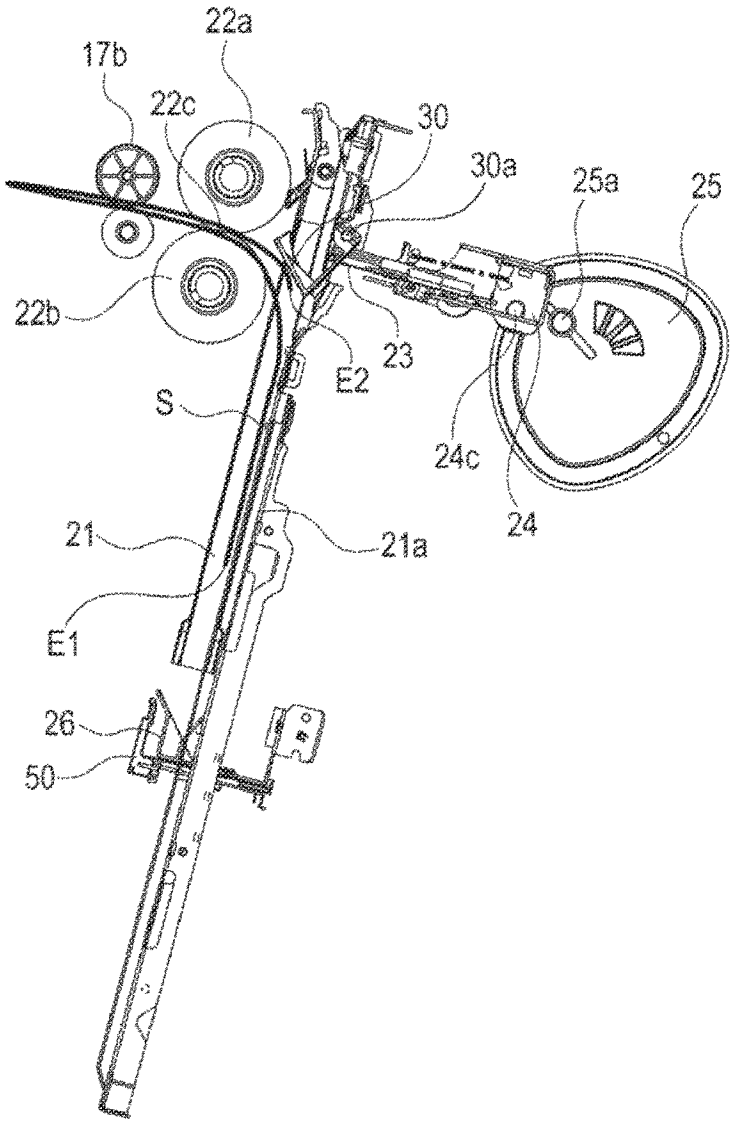

Then, when switchback conveyance is performed, the L-shaped pressing guide member 30 (see FIG. 11B) positioned at its home position is turned about the turning shaft 30*a* as illustrated in FIG. 12A (S10). This pushes the fold end E2 downward (extending direction of the intermediate tray 21 in which the sheet front end E1 is positioned). In this state, the fold roller pair 22 and discharge roller pair 17*b* are reversely driven (S11) to switch back the sheet S to the intermediate tray 21. At this time, the fold end E2 of the sheet is conveyed to the intermediate tray 21 while being guided by the guide surface of the pressing guide member 30 (see FIGS. 12A and 12B).

Figure 13B:
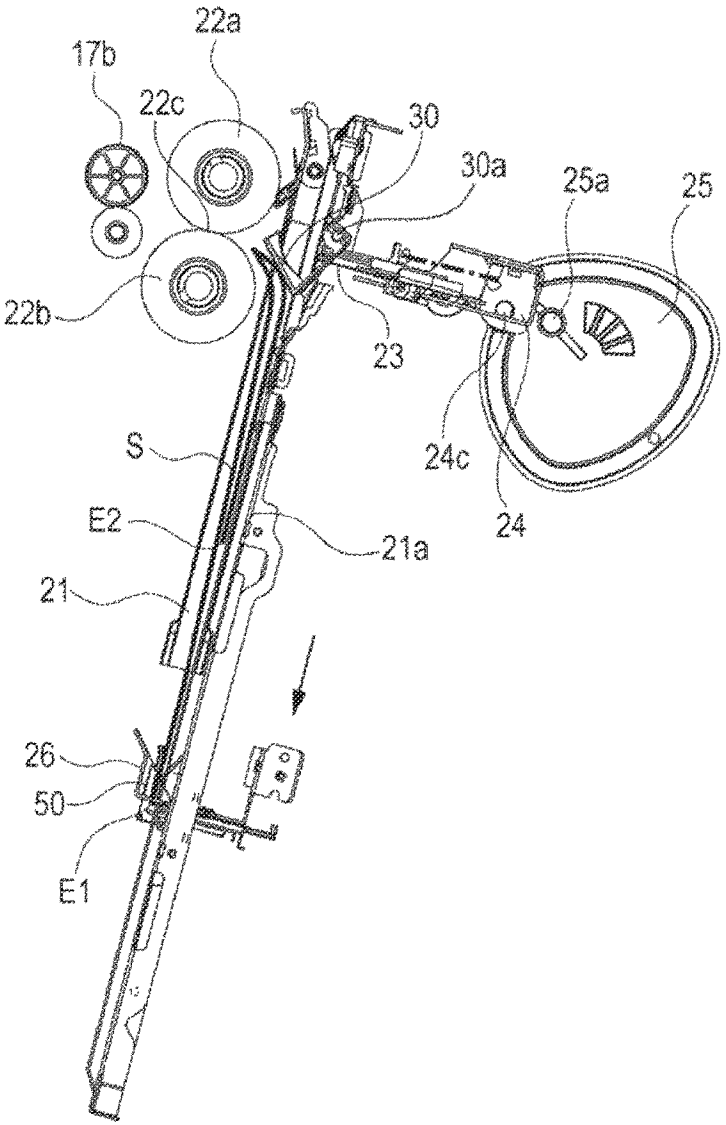
FIGS. 13A and 13B are cross-sectional views for explaining the inward threefold processing operation.
Figure 13A:
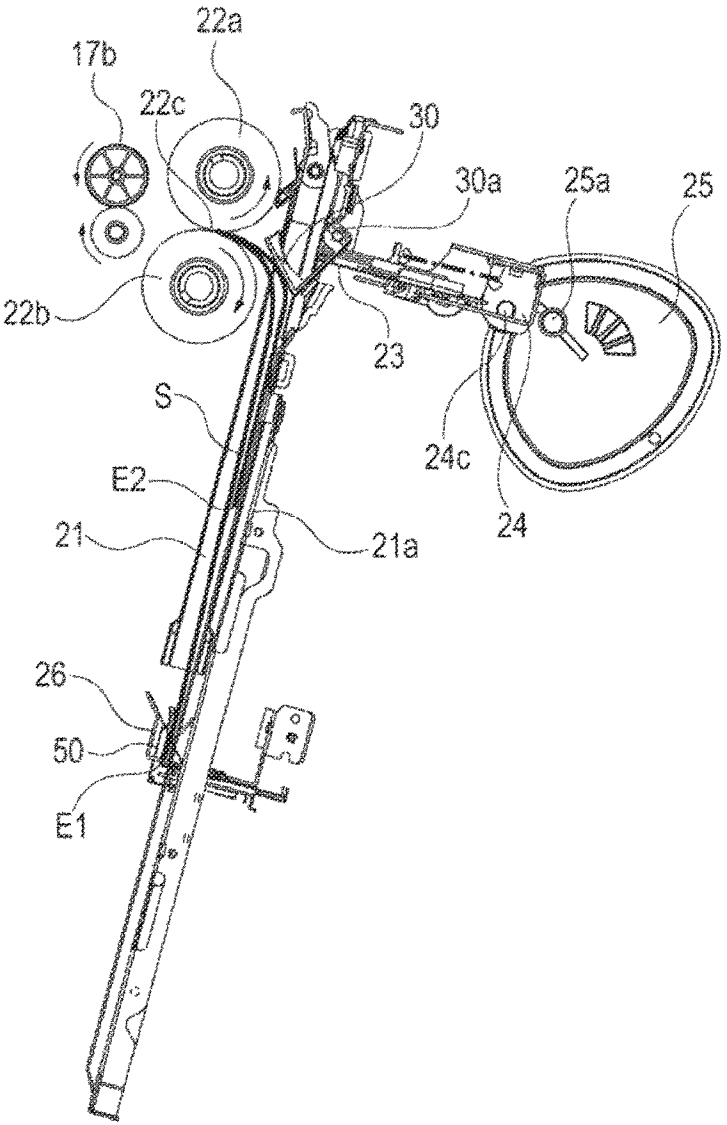

Then, as illustrated in FIG. 13A, the sheet S is conveyed by the rotation of the fold roller pair 22 until the fold line of the sheet S passes through the nip part 22*c* (S12). After the sheet S has passed through the nip part 22*c*, the sheet end E1 is pushed toward the contacting part 26*b* of the regulating stopper 26 that has been moved to the receiving position as described above to be subjected to contacting alignment (registration) along the surface of the contacting part 26*b*. In the present embodiment, the conveying amount of the sheet from when the sheet end E1 conveyed by the fold roller pair 22 contacts against the contacting part 26*b* to when the sheet passes through the nip part 22*c* is as slight as about 1 mm to 3 mm, and thus the sheet end is not buckled.

After the elapse of a small amount of time from when the sheet S passed through the nip part 22*c* as described above, the grip cam 50*e* is rotated to bring the grip unit 50 into the grip state (S13). To grip the sheet after the elapse of a predetermined period of time after the sheet S has passed through the nip part 22*c* is more effective when a plurality of sheets are subjected to fold processing at a time than when one sheet is folded as in the present embodiment. When a plurality of sheets as a sheet bundle are folded, a shift corresponding to the thickness of the sheet bundle occurs between the fold positions (fold lines) of the inner sheet and outer sheet. When the sheet bundle is switched back in the direction opposite to the direction in which the first fold processing is performed, the fold line of the inner sheet passes through the nip part 22*c* of the fold roller pair 22 earlier than the fold line of the outer sheet does, which may cause coming-apart of sheets constituting the sheet bindle, with the result that some sheets on the inner side may be conveyed toward the regulating stopper 26. At this time, as described above, the sheets are received with the grip release state maintained for a predetermined period of time. It follows that the end portions of the sheets contact against the contacting part 26*b* being stopped, whereby contacting alignment of a plurality of sheets can be achieved. The predetermined period of time may be as short as one second or less.

After the sheet S is thus gripped, and the regulating stopper 26 is moved downward to a "reverse position" as illustrated in FIG. 13B (S14). The reverse position is a position where the pressing guide member 30 can be turned without interfering with the sheet S. The sheet conveying amount to the reverse position is determined according to sheet size and fold position.

When the sheet that has passed through the nip part 22*c* of the fold roller pair 22 is returned to the reverse position of the intermediate tray 21 by free fall, a part of the sheet folded in two from the fold line to the sheet end E2 on the side closer to the fold line has a shape like the barb, thus acting as a load, which may hamper smooth movement. However, in the present embodiment, the regulating stopper 26 moves while gripping the sheet S as described above, so that the sheet can be reliably conveyed to the reverse position even in the presence of a load.

As described above, in the present embodiment, the regulating stopper 26 is moved downward after the sheet that has been subjected to the first fold processing has passed through the nip part 22*c* of the fold roller pair 22; alternatively, it may be configured such that the regulating stopper 26 is made to stand by at the position where the sheet end E1 contacts against the contacting part 26*b* before the folded sheet passes through the nip part 22*c*, and the regulating stopper 26 is moved downward with the grip unit 50 gripping the folded sheet before the sheet passes through the nip part 22*c*. In this case, the sheet moving speed by the regulating stopper 26 is controlled to be smaller than the sheet conveying speed by the fold roller pair 22. Such speed control prevents the sheet from being pulled even in a state where the sheet is moved by both the fold roller pair 22 and regulating stopper 26.

Figure 14B:
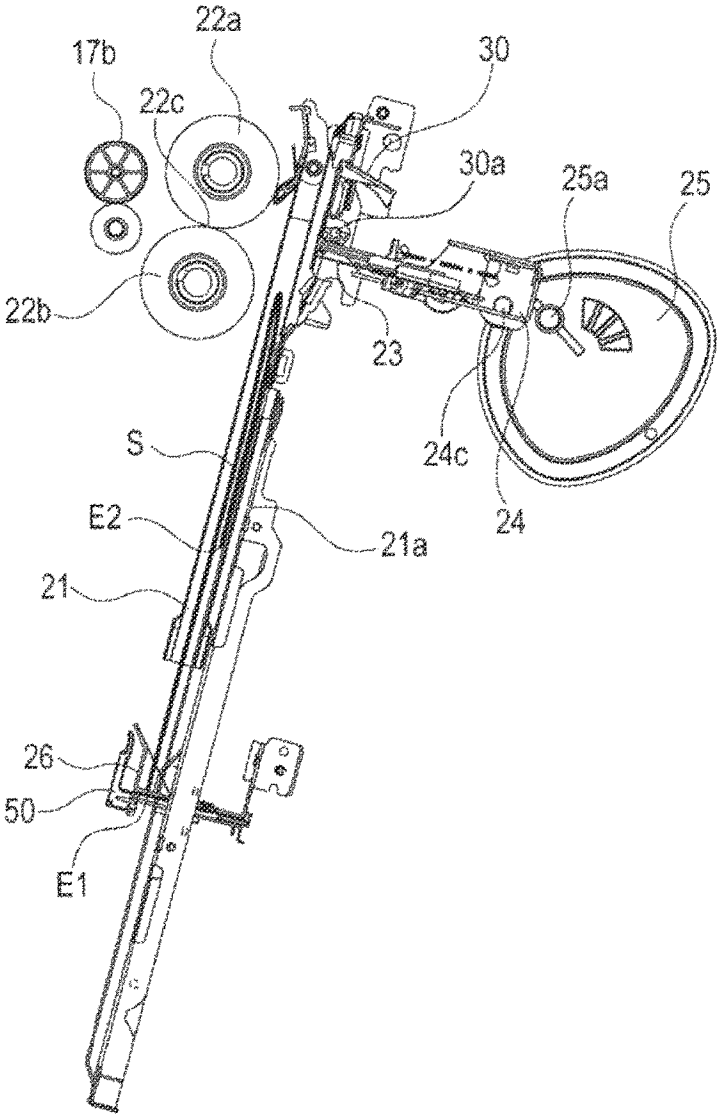
FIGS. 14A and 14B are cross-sectional views for explaining the inward threefold processing operation.
Figure 14A:
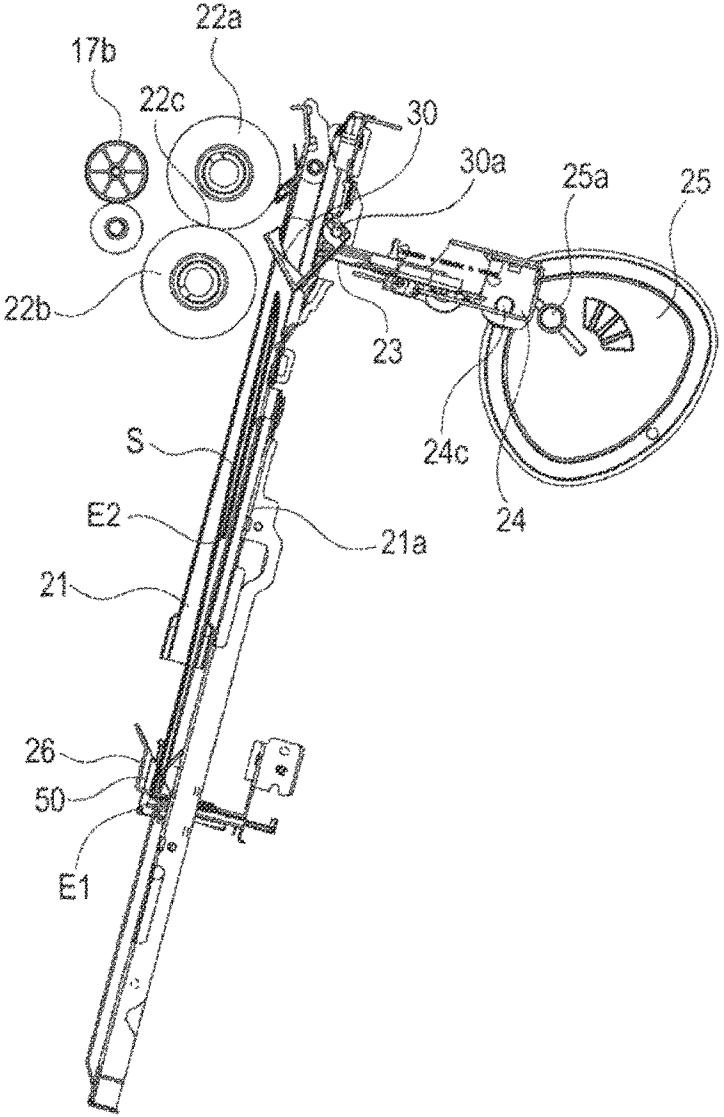

Then, after the regulating stopper 26 is moved to the reverse position, the grip of the sheet by the grip unit 50 is released (S15) as illustrated in FIG. 14B, and the pressing guide member 30 is returned to its retracting position (home position) (S16). By releasing the grip of the sheet, the sheet is allowed to contact with the contacting part 26*b* by its own weight even when registration misalignment occurs at the time of the sheet being pulled back, and contacting alignment of the sheet end portion is thus achieved.

After the grip of the sheet is once released as described above, the grip unit 50 is made to grip the sheet again (S17), and the regulating stopper 26 is moved to "a second fold processing position" (S18). The second fold processing position is a position where the fold position to be formed in the second fold processing of the sheet conveyed by the movement of the regulating stopper 26 is aligned with the fold blade 23 (see FIG. 15A). When the regulating stopper 26 is moved upward with the sheet S contacting with the contacting part 26*b*, the sheet may bunce up at the moment when the regulating stopper 26 is stopped to result in misaligned registration; however, in the present embodiment, the regulating stopper 26 is moved to the second fold processing position with the sheet gripped, preventing misaligned registration.

While the sheet is gripped before the regulating stopper 26 is moved to the second fold processing position in the present embodiment, the same effect can be obtained when the sheet is gripped in the middle of the upward movement of the regulating stopper 26.

Figure 15B:
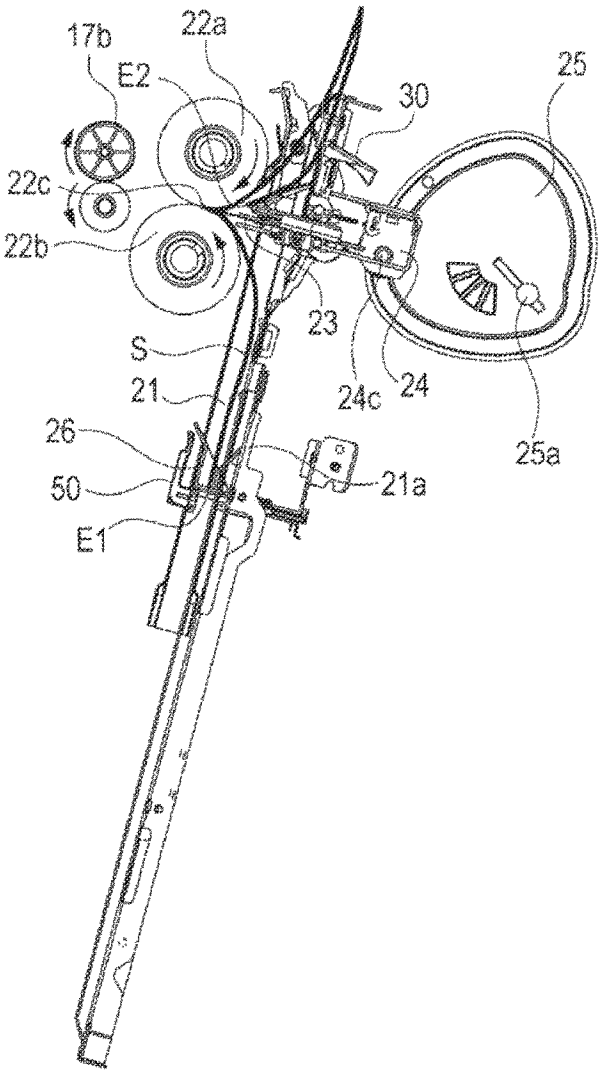
FIGS. 15A and 15B are cross-sectional views for explaining the inward threefold processing operation.
Figure 15A:
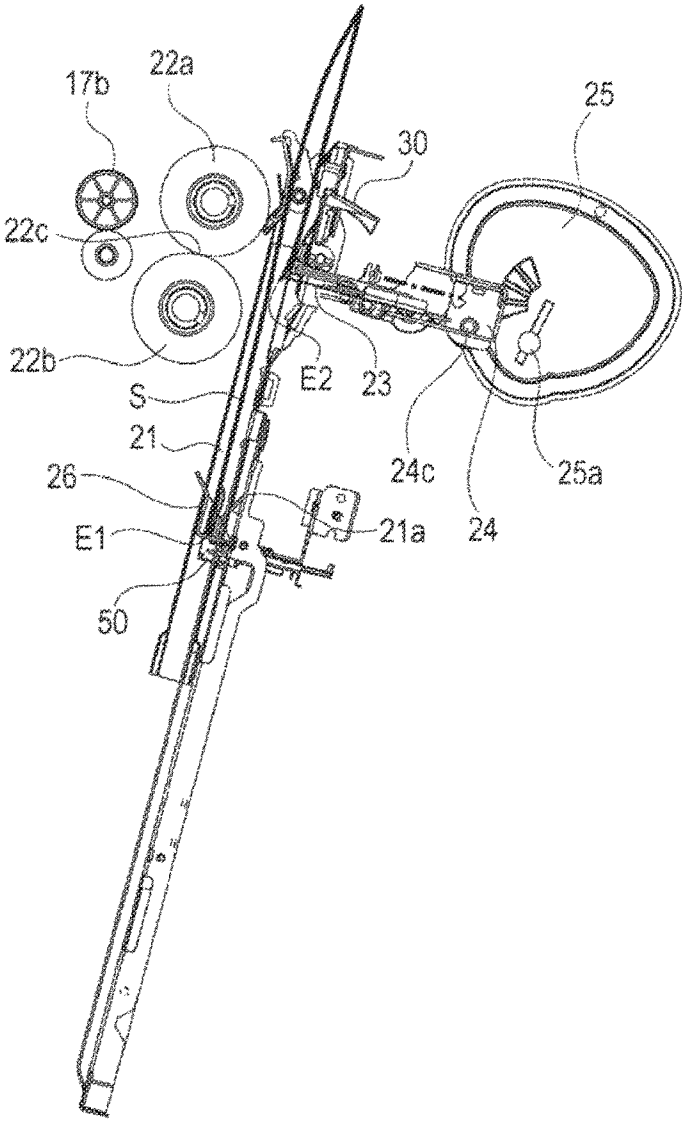

After the regulating stopper 26 is moved to the second fold processing position, the grip unit 50 releases the grip of the sheet (S19), and the cam motor 66 is driven to operate the fold blade 23 once again to thereby thrust the sheet S toward the nip part 22*c* of the fold roller pair 22 as illustrated in FIG. 15B (S20).

Figure 16B:
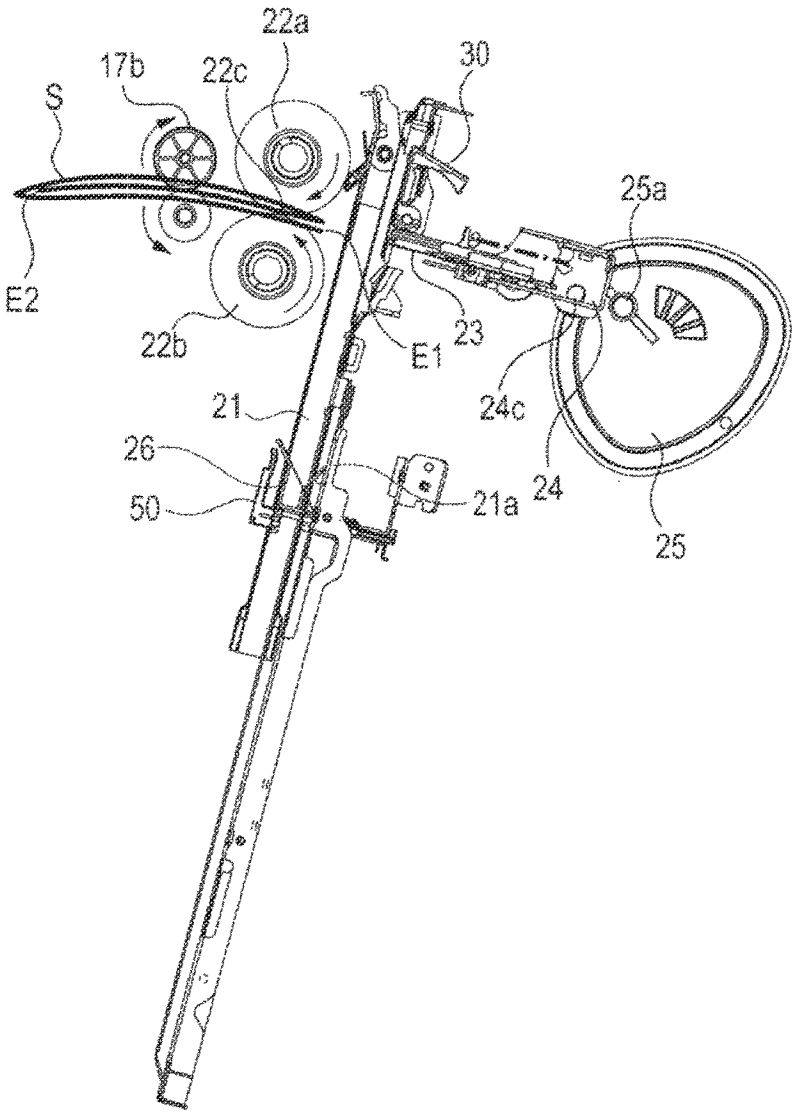
FIGS. 16A and 16B are cross-sectional views for explaining the inward threefold processing operation.
Figure 16A:
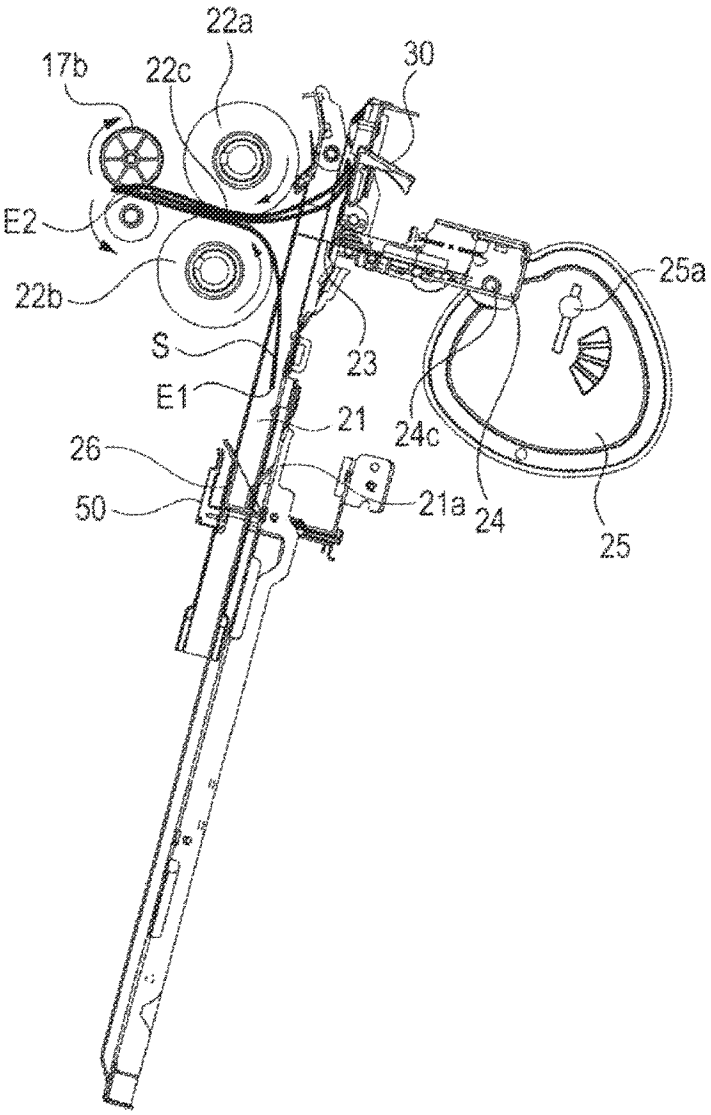

Then, in sync with the driving of the cam motor 66, the fold roller motor 67 and discharge roller motor 68 are driven into normal rotation (S21). As a result, the sheet S that has been thrust into the fold roller pair 22 by the fold blade 23 is subjected to fold processing with the fold end E2 of the sheet folded inside the sheet folded by the second fold processing as illustrated in FIGS. 16A and 16B.

Then, the sheet S that has thus been subjected to inward threefold processing is discharged onto the stack tray 17*c*, and the fold processing is ended (S22, S23).

As described above, in the present embodiment, the folded sheet S is fed back to the intermediate tray 21 while being gripped, so that the sheet can be moved accurately to a predetermined position even when a force to open the fold position acts on the sheet folded in two. Further, since the sheet is moved gripped, registration misalignment can be prevented.

This application claims the benefit of Japanese Patent Application No. 2020-207248 which is incorporated herein by reference.

The invention claimed is:

1. A sheet processing apparatus that performs fold processing in such a manner as to apply first fold processing to a sheet and then apply second fold processing at a position different from a fold line formed in the first fold processing so as to make one end of the sheet folded in the first fold processing lie inside the other end of the sheet folded in the second fold processing, the apparatus comprising:

a conveying path that guides a sheet conveyed in a predetermined conveying direction;

a position adjusting unit that has a contacting part against which a downstream side end portion in the conveying direction contacts and moves in the conveying direction and its opposite direction so as to adjust the position of the sheet;

a grip unit configured to be movable integrally with the position adjusting unit and to grip the sheet adjusted in position by the position adjusting unit;

a thrust member that thrusts the sheet adjusted in position by the position adjusting unit;

a rotating body pair that rotates while pressing the sheet thrust by the thrust member at a nip part to apply fold processing to the sheet; and a control part that controls the driving of the position adjusting unit, the grip unit, the thrust member, and the rotating body pair, the control part using the rotating body pair to apply first fold processing to the sheet conveyed to the conveying path and causing the grip unit to grip a folded sheet that has been subjected to the first fold processing when the folded sheet is fed back to the conveying path by moving the position adjusting unit.

2. The sheet processing device according to claim 1, wherein the control part moves, when the folded sheet that has been subjected to the first fold processing is fed back to the conveying path, the position adjusting unit to a position where the folded sheet can be gripped by the grip unit before the sheet passes through the nip part.

3. The sheet processing device according to claim 1, wherein the control part rotates, when the folded sheet that has been subjected to the first fold processing is fed back to the conveying path, the rotating body pair in a direction opposite to a direction in which the folding processing is performed and moves, before the folded sheet passes through the nip part of the rotating body pair, the position adjusting unit to a position where a downstream end portion in the conveying direction of the sheet can contact with the contacting part.

4. The sheet processing device according to claim 1, wherein a grip part of the grip unit is provided at a position closer to the rotating body pair than the contacting part of the position adjusting unit.

5. The sheet processing device according to claim 1, wherein the control part rotates, when the folded sheet that has been subjected to the first fold processing is fed back to the conveying path, the rotating body pair in a direction opposite to a direction in which the folding processing is performed and causes the grip unit to grip the folded sheet after the folded sheet has passed through the nip part of the rotating body pair.

6. The sheet processing device according to claim 3, wherein the control part moves, when the folded sheet that has been subjected to the first fold processing by the movement of the position adjusting unit is moved in a direction of returning to the conveying path, the position adjusting unit at a speed lower than a sheet conveying speed by the rotating body pair.

7. The sheet processing device according to claim 1, wherein the control part causes, when the folded sheet that has been subjected to the first fold processing is moved from a predetermined position of the conveying path to a second fold position by the movement of the position adjusting unit, the grip unit to grip the folded sheet.

8. The sheet processing device according to claim 7, wherein the control part causes the grip unit to release the grip of the sheet after the sheet is moved to the second fold processing position by the position adjusting unit.

9. An image forming system comprising:

an image forming apparatus that forms images on a sheet; and a sheet processing apparatus that applies fold processing to a sheet fed from the image forming apparatus, wherein the sheet processing apparatus is the sheet processing apparatus as claimed in claim 1.

* * * * *